US010329061B2

(12) United States Patent
Dias et al.

(10) Patent No.: US 10,329,061 B2
(45) Date of Patent: Jun. 25, 2019

(54) SYSTEM AND METHODS FOR MANAGING A CONTAINER OR ITS CONTENTS

(71) Applicant: Thermos L.L.C., Schaumburg, IL (US)

(72) Inventors: Rick Dias, Lake In The Hills, IL (US); Marvin Lane, Wheeling, IL (US); Shawn Young, Algonquin, IL (US); Michael Dennis Tetreault, Simsbury, CT (US); Michael Murray, Wethersfield, CT (US); Gary Victor Pieper, Wallingford, CT (US); Eric Lee Ferguson, Simsbury, CT (US)

(73) Assignee: THERMOS L.L.C., Schaumburg, IL (US)

( * ) Notice: Subject to any disclaimer, the term of this patent is extended or adjusted under 35 U.S.C. 154(b) by 927 days.

(21) Appl. No.: 14/534,800

(22) Filed: Nov. 6, 2014

(65) Prior Publication Data

US 2015/0122688 A1 May 7, 2015

Related U.S. Application Data

(63) Continuation of application No. 29/486,557, filed on Mar. 31, 2014, now Pat. No. Des. 731,251, and a
(Continued)

(51) Int. Cl.
*B65D 51/24* (2006.01)
*B65D 43/02* (2006.01)
(Continued)

(52) U.S. Cl.
CPC ..... *B65D 51/245* (2013.01); *A47G 19/025* (2013.01); *A47G 19/027* (2013.01);
(Continued)

(58) Field of Classification Search
CPC ..... B65D 51/245; B65D 43/0202; A47G 19/025; A47G 19/2227; A47G 2019/225
(Continued)

(56) References Cited

U.S. PATENT DOCUMENTS

D987,597 1/1911 Habig
2,187,558 A 1/1940 Kushima
(Continued)

FOREIGN PATENT DOCUMENTS

AU 2005276947 A1 3/2006
AU 2002259233 B2 12/2007
(Continued)

OTHER PUBLICATIONS

PCT/US14/64374 International Search Report and Written Opinion dated Mar. 26, 2015 (14 pages).
(Continued)

*Primary Examiner* — Steven A. Reynolds
*Assistant Examiner* — Javier A Pagan
(74) *Attorney, Agent, or Firm* — Polsinelli PC

(57) ABSTRACT

Certain embodiments of the present invention include a retainer, a lid, and a sensor, where the sensor is configured to detect information about the retainer, the lid, or the contents in the retainer. The sensor also may be configured to communicate with an internal or external computer system, thereby facilitating showing the detected information as a representation via a display element. In certain embodiments, the system may include an action element such as an open/close lid opening assembly configured to permit automatically or manually opening or closing a drink aperture or another type of dispensing aperture.

29 Claims, 36 Drawing Sheets

Related U.S. Application Data continuation of application No. 29/486,563, filed on Mar. 31, 2014, now Pat. No. Des. 735,035, and a continuation of application No. 29/499,405, filed on Aug. 14, 2014, now Pat. No. Des. 780,578.

(60) Provisional application No. 61/901,133, filed on Nov. 7, 2013, provisional application No. 61/974,230, filed on Apr. 2, 2014, provisional application No. 62/003,409, filed on May 27, 2014.

(51) Int. Cl.
*A47G 19/02* (2006.01)
*A47G 19/22* (2006.01)

(52) U.S. Cl.
CPC ..... *A47G 19/2227* (2013.01); *A47G 19/2288* (2013.01); *B65D 43/0202* (2013.01); *A47G 2019/225* (2013.01); *A47G 2019/2238* (2013.01); *A47G 2019/2244* (2013.01)

(58) Field of Classification Search
USPC ..... 206/459.1; 220/200, 211, 212, 324; 340/870.16
See application file for complete search history.

(56) References Cited

U.S. PATENT DOCUMENTS 2,746,265 A 5/1956 Mills
D213,292 S 2/1969 Arsenault et al.
D246,600 S 12/1977 Kurata
D281,581 S 12/1985 MacEwen
5,318,197 A 6/1994 Martindale et al.
5,379,916 A 1/1995 Martindale et al.
5,495,793 A 3/1996 Muis et al.
D374,399 S 10/1996 Neveras et al.
5,678,925 A 10/1997 Garmaise et al.
D403,964 S 1/1999 Jansen
5,881,868 A 3/1999 Soyak et al.
6,036,055 A 3/2000 Mogadam et al.
D425,618 S 5/2000 Niermann et al.
6,119,888 A 9/2000 Goto et al.
D441,288 S 5/2001 Pillers et al.
D448,294 S 9/2001 Alscher et al.
D451,023 S 11/2001 Kitamura et al.
6,857,755 B1 2/2005 Lewis
6,859,745 B2 2/2005 Carr et al.
6,903,874 B1 6/2005 Karterman
7,017,807 B2 3/2006 Kipp et al.
71,048,179 5/2006 Claessens et al.
7,061,382 B2 6/2006 Claessens et al.
7,088,258 B2 8/2006 Morrison
D528,862 S 9/2006 Li
7,109,863 B2 9/2006 Morrison
7,126,479 B2 10/2006 Claessens et al.
7,183,936 B2 2/2007 Ritson
75,189,134 3/2007 Nugent et al.
7,267,250 B2 9/2007 Rudduck et al.
7,336,194 B2 2/2008 Hillman et al.
7,364,089 B2 4/2008 Claessens et al.
D573,017 S 7/2008 Henderson
D574,507 S 8/2008 Muir et al.
7,417,417 B2 8/2008 Williams et al.
D587,581 S 3/2009 DeMarco et al.
7,501,933 B2 3/2009 Rousso et al.
D596,440 S 7/2009 Rothberg et al.
D596,460 S 7/2009 Nezu
D596,944 S 7/2009 Mueller et al.
D597,838 S 8/2009 Stuart
7,573,395 B2 8/2009 Morrison et al.
7,613,431 B2 11/2009 Brand
D608,640 S 1/2010 Carreno
7,712,364 B2 5/2010 Radhakrishnan et al.
7,740,368 B2 6/2010 Chiang
RE41,605 E 8/2010 Karterman
7,766,545 B2 8/2010 Salkeld
D623,473 S 9/2010 Chen
7,798,373 B1 9/2010 Wroblewski et al.
7,888,898 B2 2/2011 Wilkerson
7,933,733 B2 4/2011 Ashrafzadeh et al.
D640,505 S 6/2011 George
7,954,711 B2 6/2011 Adstedt et al.
D641,591 S 7/2011 Tsukida
8,011,816 B1 9/2011 Janda
D655,134 S 3/2012 Gilbert
D655,580 S 3/2012 Kotani
D655,983 S 3/2012 Cozzolino et al.
D658,443 S 5/2012 Chiu et al.
D660,081 S 5/2012 Gilbert
8,172,454 B2 5/2012 Choi
D666,490 S 9/2012 Leon
D668,116 S 10/2012 Eyal
8,286,821 B2 10/2012 Mejia et al.
8,336,665 B1 12/2012 Saunders
D675,059 S 1/2013 Carreno
8,357,846 B2 1/2013 Strobel et al.
D675,865 S 2/2013 Wahl
8,368,539 B2 2/2013 Adstedt et al.
8,378,830 B2 2/2013 Moran
8,429,965 B2 4/2013 Radhakrishnan et al.
8,432,249 B2 4/2013 Bailey-VanKuren et al.
8,453,878 B2 6/2013 Palmquist
8,477,029 B2 7/2013 Ashrafzadeh et al.
8,550,288 B2 10/2013 Briar et al.
8,560,403 B2 10/2013 Adstedt et al.
8,590,743 B2 11/2013 Beland et al.
8,608,026 B1 12/2013 Temko et al.
8,618,448 B2 12/2013 Alexander
D700,513 S 3/2014 Carsrud et al.
D704,053 S 5/2014 Kim
D707,557 S 6/2014 Corradini et al.
D707,558 S 6/2014 Corradini et al.
D715,143 S 10/2014 Hewitt et al.
D718,626 S 12/2014 Lane
D720,574 S 1/2015 Boroski
D721,920 S 2/2015 Coon et al.
D731,240 S 6/2015 Bell et al.
2001/0036124 A1 11/2001 Rubenstein
2004/0123620 A1 7/2004 Porter
2005/0035011 A1 2/2005 McRobbie
2005/0121431 A1 6/2005 Yuen
2005/0194402 A1 9/2005 Morrison
2006/0139928 A1 6/2006 Griffiths et al.
2007/0125162 A1 6/2007 Ghazi et al.
2007/0181585 A1 8/2007 Lane
2008/0195251 A1 8/2008 Milner
2008/0296191 A1 12/2008 Ransch
2009/0045959 A1 2/2009 Adstedt et al.
2009/0139324 A1 6/2009 Morimoto et al.
2009/0159552 A1 6/2009 Cano-Pey et al.
2010/0025267 A1 2/2010 Brand
2010/0045705 A1 2/2010 Vertegaal et al.
2010/0101317 A1 4/2010 Ashrafzadeh et al.
2010/0102930 A1 4/2010 McCoy
2010/0102967 A1 4/2010 Lee et al.
2010/0106515 A1 4/2010 McCoy
2010/0106521 A1 4/2010 Ashrafzadeh et al.
2010/0106624 A1 4/2010 Ashrafzadeh et al.
2010/0106625 A1 4/2010 McCoy
2010/0106626 A1 4/2010 Ashrafzadeh et al.
2010/0156614 A1 6/2010 Adstedt et al.
2010/0182518 A1 7/2010 Kirmse et al.
2010/0200602 A1 8/2010 Chan
2011/0050431 A1 3/2011 Hood et al.
2011/0053283 A1 3/2011 Hood et al.
2011/0108570 A1* 5/2011 Jarisch ..... A47J 31/40 99/453
2011/0153398 A1 6/2011 Tjhai et al.
2011/0180563 A1 7/2011 Fitchett et al.
2011/0253715 A1 10/2011 Phaneuf et al.
2011/0298582 A1 12/2011 August et al.
2012/0074154 A1 3/2012 Ming Ki Gordon et al.
2012/0103562 A1 5/2012 Alexander

(56) References Cited

U.S. PATENT DOCUMENTS

| | | | | |
|---|---|---|---|---|
| 2012/0187075 | A1* | 7/2012 | El-Saden | B65D 47/066 215/389 |
| 2012/0217244 | A1 | 8/2012 | Phaneuf et al. | |
| 2012/0222339 | A1 | 9/2012 | Dubinski | |
| 2012/0228388 | A1 | 9/2012 | Kuo et al. | |
| 2012/0293332 | A1* | 11/2012 | Rosenfeld | A47J 41/0027 340/584 |
| 2013/0062232 | A1 | 3/2013 | Saunders | |
| 2013/0105434 | A1 | 5/2013 | Levy | |
| 2013/0115343 | A1 | 5/2013 | Reyhanloo | |
| 2013/0127748 | A1 | 5/2013 | Vertegaal et al. | |
| 2013/0145324 | A1 | 6/2013 | Kelly et al. | |
| 2013/0228584 | A1 | 9/2013 | Khatchaturian | |
| 2013/0273843 | A1 | 10/2013 | Shimota et al. | |
| 2013/0307683 | A1 | 11/2013 | Greenberg et al. | |
| 2013/0319966 | A1 | 12/2013 | Lane | |
| 2013/0342316 | A1 | 12/2013 | Ghaffari et al. | |
| 2013/0346169 | A1 | 12/2013 | Tjhai et al. | |
| 2014/0008443 | A1 | 1/2014 | Chang et al. | |
| 2014/0042178 | A1 | 2/2014 | Brannock | |
| 2014/0042183 | A1 | 2/2014 | Beland et al. | |
| 2014/0053944 | A1 | 2/2014 | Wang | |
| 2014/0059133 | A1 | 2/2014 | Wang | |
| 2014/0059581 | A1 | 2/2014 | Wang | |
| 2014/0059621 | A1 | 2/2014 | Wang | |
| 2014/0152323 | A1 | 6/2014 | Kumar et al. | |
| 2014/0303790 | A1 | 10/2014 | Huang et al. | |
| 2014/0311239 | A1 | 10/2014 | Marjanovic et al. | |
| 2014/0332433 | A1 | 11/2014 | Lyall, III et al. | |
| 2015/0024349 | A1 | 1/2015 | Bischoff et al. | |
| 2015/0309611 | A1 | 10/2015 | Vertegaal et al. | |

FOREIGN PATENT DOCUMENTS

| | | | |
|---|---|---|---|
| AU | 2002234439 | B2 | 6/2008 |
| AU | 2009235936 | A1 | 10/2009 |
| AU | 2003217045 AA | | 1/2010 |
| AU | 2009273375 | B2 | 4/2010 |
| AU | 2010271093 | | 1/2011 |
| AU | 2008251929 | A1 | 9/2012 |
| AU | 2012265589 | A1 | 3/2013 |
| CA | 2 568 627 | A1 | 11/2006 |
| CA | 2 583 744 | A1 | 4/2007 |
| CA | 2 440 089 | A1 | 11/2008 |
| CA | 2 440 089 | C | 11/2008 |
| CA | 2 686 553 | A1 | 11/2009 |
| CA | 2 731 423 | A1 | 1/2010 |
| CA | 2 440 728 | A1 | 5/2011 |
| CA | 2 787 831 | A | 8/2011 |
| CA | 2800615 | A1 | 10/2011 |
| CA | 2 836 544 | A1 | 11/2012 |
| CA | 2 767 741 | A1 | 1/2013 |
| CA | 2 788 161 | A | 3/2013 |
| CA | 2 816 690 | A1 | 4/2013 |
| CA | 2 542 043 | C | 5/2013 |
| CN | 2613150 | Y | 4/2004 |
| CN | 200963087 | Y | 10/2007 |
| CN | 102238891 | A | 11/2011 |
| CN | 103445617 | A | 12/2013 |
| EP | 0 627 186 | B1 | 12/1997 |
| EP | 1 373 084 | A1 | 1/2004 |
| EP | 1 487 713 | A1 | 12/2004 |
| EP | 1 591 371 | A2 | 11/2005 |
| EP | 1 636 111 | A1 | 3/2006 |
| EP | 1 665 135 | B1 | 6/2006 |
| EP | 1 738 336 | A2 | 1/2007 |
| EP | 1 825 233 | A2 | 8/2007 |
| EP | 1 388 20 | A1 | 10/2011 |
| EP | 2 511 857 | A2 | 10/2012 |
| EP | 2 558 381 | A2 | 2/2013 |
| EP | 2 306 872 | B1 | 5/2013 |
| EP | 2 599 732 | A1 | 6/2013 |
| EP | 2 659 808 | A1 | 6/2013 |
| EP | 2 619 529 | A2 | 7/2013 |
| EP | 2 645 298 | A1 | 10/2013 |
| EP | 2 662 304 | A1 | 11/2013 |
| JP | S62298687 | A | 12/1987 |
| JP | 2012-501278 | A | 1/2012 |
| JP | 2013-071745 | A | 4/2013 |
| JP | 2013-107679 | A | 6/2013 |
| WO | 2008140732 | A2 | 11/2008 |
| WO | 2010009975 | A2 | 1/2010 |
| WO | 2012040461 | A2 | 3/2012 |
| WO | 2012061527 | A1 | 5/2012 |
| WO | 2012102759 | A1 | 8/2012 |
| WO | 2012162059 | A3 | 11/2012 |
| WO | 2012175693 | A3 | 12/2012 |
| WO | 2013059454 | A2 | 4/2013 |
| WO | 2013079141 | A1 | 6/2013 |
| WO | 2013085865 | A1 | 6/2013 |
| WO | 2013138412 | A1 | 9/2013 |
| WO | 2013143923 | A1 | 10/2013 |
| WO | 2013164110 | A1 | 11/2013 |

OTHER PUBLICATIONS

Bootic. Thermos. Oct. 29, 2013 [online], [site visited Feb. 5, 2015]. Available from Internet, <URL:http://www.bootic.com/thermos/home-and-garden/kitchen-and-dining/tableware/drinkware/thermos-nissan-16-ounce-stainless-steel-backpack-bottle>.

YouTube. Themos Nissan 16-Ounce Stainless-Steel Backpack Bottle Review. Feb. 23, 2013 [online], [site visited Feb. 5, 2015]. Available from Internet, <URL:https://www.youtube.com/watch?v=8PnmUihk_uQ>.

CN 2014800612958-1 Office Action with translation; Jun. 2, 2017 (28 pages).

CN 2014800612958-1 Office Action with translation; Jan 23, 2018 (23 pages).

SG 11201603605X Written Opinion; Feb. 14, 2014; (6 pages).

CL 201601087 Office Action; 2016-05-056; (15 pages).

AU 2014346731 Examination Report; Jun. 30, 2017; (4 pages).

CA 2928946 Examination Report; Oct. 18, 2017; (4 pages).

EP 14860224.6 Extended Search Report; Aug. 1, 2017; (8 pages).

EP 14860224.6 Invitation Pursuant To Rule 62a(1)EPC; Mar. 15, 2017; (2 pages).

You Tube. Thermos Nissan 16-Ounce Stainless-Steel Backpack Bottle Reivew; Feb 23, 2013 [online]; [site visited Feb. 5, 2015]; https://www.youtube.com/watch?v=8PnmUihk_uQ>.

U.S. Appl. No. 29/536,881 Office Action; dated May 20, 2016; (13 pages).

"Brian's Thermos"—STL Solidworks—3D CAD model; found online Aug. 10, 2015 at grabcad.com; page dated Jan. 25, 2012; retrieved from https://grabcad.com/library/brian-s-thermos.

Thermos Connected Hydration Water Bottle with Smart Lid; www.Target.com; 5 pages; found online May 16, 2016 at http://www.target.com/p/thermos-connected-hydration-bottle-with-smart-lid-teal/-/A-24010647.

CA 2928946 Office Action Issued Sep. 7, 2018; (5 pages).

JP 2016-528194 Office Action dated Nov. 27, 2018, with translation; (20 pages).

EP 14860224.6 Office Action dated Sep. 27, 2018; (4 pages).

KR 10-2016-7014919 Office Action dated Jul. 31, 2018, with translation; (77 pages).

"Thermal Freshtrac(TM) (TFT) 64 Ounce Thermal Dispensers"; Models: TFT64, TFT64D; Wilbur Curtis; accessed Sep. 4, 2014; (2 pages).

"Stay hydrated with the BluFit smart water bottle and app"; Steven Sande @stevensande; accessed Oct. 15, 2015; (5 pages).

"H2OPal Hydration Tracker"; by H2OPal; https://www.amazon.com/H20Pal-2AETMDOH20-B1-HydraTracker/dp/ B018YEAQCA/ref=sr_1_1?ie=UTF8&qid=1479412993&sr=8-1&keywords=h2Opal; accessed Nov. 17, 2016; (8 pages).

"Smart" water bottle startup launches crowdfunding campaign; Katharine Grayson; TECHFLASH; Jun. 1, 2015; 2:55pm CDT; accessed Jun. 4, 2015; (5 pages).

(56) References Cited

OTHER PUBLICATIONS

Hydracoach(TM) hydradation monitors; accessed Oct. 15, 2016.
"Meet IQhydr8;"; American Diabetes Association; http://www.iqhydr8.com/; accessed Nov. 13, 2014; (4 pages).
"Johnnie Walker Smart Bottle Debuts At Mobile World Congress"; Jennifer Hicks (http://www.forbes.com/sites/jenniferhicks/); TECH (/TECHNOLOGY); Mar. 2, 2015 @ 12:18 PM; accessed Jul. 13, 2015; (6 pages).
"Log how much water you're drinking with the Oaxis smart bottle"; Aloysius Low; Jun. 2, 2015 5:11 AM PDT; accessed Jun. 11, 2015; (4 pages).
Smart Design partners with Gatorade; Announcement: Jun. 12, 2014; accessed Jul. 16, 2015; (5 pages).
"Trago—The World's First Smart Water Bottle"; created by Jac & Davis Saltzgiver; Kickstarter; accessed Jul. 14, 2015; (26 pages).
Mark One Pryme Vessyl Personal Hydration Tracker; (https://www.amazon.com/Mark-One-Vessyl-Personal-Hydration/dp/B01HMU687Y); accessed Jan. 2, 2019; (7 pages).

* cited by examiner

SYSTEM AND METHODS FOR MANAGING A CONTAINER OR ITS CONTENTS

CROSS REFERENCE TO RELATED APPLICATIONS

This application claims the benefit of U.S. Provisional Application No. 61/901,133 filed Nov. 7, 2013, U.S. Design application No. 29/486,557 filed Mar. 31, 2014, U.S. Design application No. 29/486,563 filed Mar. 31, 2014, U.S. Provisional Application No. 61/974,230 filed Apr. 2, 2014, U.S. Provisional Application No. 62/003,409 filed May 27, 2014, and U.S. Design application Ser. No. 29/499,405 filed Aug. 14, 2014, each of which is incorporated by reference in its entirety.

FIELD OF THE INVENTION

The present invention relates generally to a container management system, embodiments of which are configured to communicate with or include a computer system.

BACKGROUND OF THE INVENTION

Consumers often use containers to store food, beverages, other consumable products, cleaning products, and other non-consumable products. Basic containers permit the consumer only to store a product, but typically provide little information about the current status or historical status of the product.

For example, a basic beverage container may be configured to store a beverage. However, to obtain information about the current status of the beverage or its container, the consumer typically must physically manipulate the beverage container. As an example, to test the temperature of the beverage in the container, the consumer might touch the outside of the container, drink some of the beverage, pour a small amount of the beverage onto their hand, or dip a finger into the beverage. If the beverage is too hot, such "testing" methods might cause a burn. Also, such testing methods may be unsanitary or otherwise contaminate the beverage.

Some more advanced containers may include a thermometer positioned within the container so that the consumer can assess the temperature without risking a burn or contaminating the beverage. However, even such advanced containers generally permit the consumer to view the temperature reading only from the thermometer itself or an integrated thermometer output display. Such containers generally lack the ability to track the temperature readings over time or permit the consumer to ascertain the temperature of the beverage from a remote location (e.g., while container is in a car and consumer is running errands).

Another disadvantage of known beverage containers is the possibility of spilling or otherwise inadvertently releasing some of the beverage from the container. Certain types of lids are designed to minimize spilling. For example, such lids may include a removable barrier positionable over a pour spout or drinking opening. However, such lids do not effectively minimize spillage if the barrier is not in place when the container tips over.

Clearly, there is a need for a container management system configured to permit detecting, tracking, recording, and communicating information about the container or its contents, such information which may include temperature of the container contents or instructions to automatically cover a lid opening. Certain embodiments of the present invention satisfy this need.

SUMMARY OF THE INVENTION

Certain embodiments of a container management system and related methods include a container system having a lid or a retainer, either of which may be configured to communicate with or include a computer system. The container management system also may be comprised of various sensors, action elements, computer elements, and additional components, which are described in more detail below.

For purposes of this application, a "retainer" is any item configured to generally hold in place a consumable product or a non-consumable product. A retainer may contain not only products, but also other contents, e.g., ambient air, vacuum space, etc. Examples of a retainer include a bottle, cup, mug, tumbler, flask, pitcher, carafe, pump pot, coffeepot, teapot, canteen, decanter, cup-holder, jar, can, drum, vial, syringe, box, cooler, lunch kit, or bag.

A retainer may include a retainer body configured to receive a product. More specifically, a retainer body may be sized and shaped to define a retainer space. The retainer body may be made from any suitable material, including a generally rigid material, a generally flexible material, a generally insulated material, or a generally non-insulated material. Examples of retainer body materials include metal (e.g., stainless steel), glass, rubber, silicone, plastic (e.g., food grade plastic), or any combination thereof. An insulated material may include a double-wall vacuum insulated construction or foam insulation.

The retainer body may terminate at a retainer edge, which generally defines a retainer opening. A retainer opening may be sized and shaped to permit inserting or pouring a product into the retainer space.

For purposes of this application, a "lid" is any item configured to partially or completely cover a retainer opening and, together with the retainer, generally create an enclosed retainer space. The components of the lid may be made from any suitable material. Examples of lid materials include metal (e.g., stainless steel), glass, rubber, silicone, plastic (e.g., food grade plastic), or any combination thereof. The lid and the retainer may be made from the same material or different materials relative to one another.

Certain embodiments of a lid may be configured to removably connect to a retainer, usually near the retainer edge. Examples of removable connections between a lid and a retainer include complementary threads, snap engagement, or a frictional configuration.

A lid may be configured to permit dispensing or releasing the product out of the retainer space without removing the lid from the retainer. Such lids may have a first lid edge defining a first lid opening configured as a dispensing aperture. The dispensing aperture may include a pour aperture, pour spout, drink aperture, drink spout, faucet spout, spray spout, straw, push-pull cap, nozzle, other aperture, to name a few examples. Certain embodiments of a lid may have additional lid edges defining additional lid openings such as a vent aperture, or system output aperture such as a display element aperture, lid input element aperture, or a computer element aperture. Any aperture configured to receive another element may be sized and shaped such that an appropriate sealing element may be positioned to generally seal (or minimize leakage in) the space between the lid edge and the other element.

In certain embodiments, the lid includes a lid body having a single unit construction, while in other embodiments the lid body has multiple components. A multi-component lid body may include a lid shell element, a lid handle element, and a lid support element. A lid shell element may form the uppermost or outermost part of the lid. A lid handle element is a component configured to permit a user to easily grip or lift the container system. A lid support element may be configured to provide a frame for certain other elements of the system, if present, such as the lid shell, any sensors, action elements, or computer elements.

Certain embodiments of a retainer or lid include a vent aperture configured to release pressure from the retainer space. Each vent aperture may include a valve configured to minimize spilling of the beverage from the container system. Also a vent aperture may be positioned to minimize spilling of the beverage from the container system.

The system and methods of the present invention may include one or more sensors, each configured to detect a characteristic or event related to the retainer, lid, or contents of the retainer. Each sensor may be disposed in or on a lid or a retainer or may be suspended from a lid or retainer. Each sensor may be configurable to detect some condition at certain regular or irregular time intervals, upon response to detecting a first condition (e.g., upon detecting change in orientation, detecting a certain volume; upon detecting a change in GPS location; detecting a certain temperature; etc.), upon receiving a request for information, upon response to user instructions provided via user input, or some combination of these or other circumstances.

Examples of a sensor include a temperature sensor, orientation sensor, capacity sensor, volume sensor, location sensor, pressure sensor, image sensor, thermal image sensor, float sensor, lid removal sensor, strain gauge or force sensor, optical recognition sensor, pH sensor, evaporative gas sensor, inductive sensor, Hall effect sensor or switch, resistive sensor, or other type of sensor known in the art. Certain sensor embodiments are discussed in more detail below.

More specifically, a temperature sensor may be disposed to detect, for example, the temperature of the product in the retainer, the temperature of the retainer, the temperature of the lid, or the temperature of ambient air in the retainer space. Examples of a temperature sensor include a thermocouple, thermistor, resistance temperature detector, platinum resistance thermometer, organic-liquid-filled thermometer, or other type of thermometer.

An orientation sensor may be disposed to detect, for example, the orientation of the container system or the contents therein. Examples of an orientation sensor include an accelerometer, gyroscope, piezoelectric sensor, tilt sensor, or tilt switch.

A volume sensor may be disposed to detect, for example, how much product is present in the retainer. A volume sensor may include a sensor configured to measure the distance between the sensor itself and a top surface of a product. For example, ultrasonic waves may be emitted from a wave initiator and a wave receiver may measure how long it takes for such waves to bounce back. Another type of volume sensor may use capacitive sensing in which a first capacitance element creates an electrostatic field that interacts with a surface of the product. Then, a field analyzing element measures the field after such interaction and such measurement can be used to calculate the distance between the volume sensor and a surface of the product.

In other embodiments, multiple volume sensors may be positioned along the inside of the retainer or a descending portion of the lid, such that if a certain volume sensor is in contact with the product, the retainer is at least as full as the height of the volume sensor. Embodiments of such sensing may be termed "point level measurement".

In still additional embodiments, a volume sensor may be sized and shaped to be disposed along the entire or partial length or height of a retainer to sense whether the product is present or not, and if so, how much is present. When the product is a liquid or other conductive substance, a volume sensor may employ continuous capacitance or parasitic capacitance. Such a capacitance volume sensor may use indirect capacitance such that the sensor does not need to be directly in contact with the liquid, and instead, the sensor is protected by some layer of material or protection element.

A location sensor may be configured to detect the geographic location of the container system. Examples of a location sensor include a global positioning system (GPS), other satellite navigation system, other triangulation systems, compass, or magnetic field sensor. A location sensor also may be used, in combination with map information, by the system to ascertain and alert the user if they are close to a beverage vendor, other restaurant, vending machine, drinking fountain, or other location related to a product. The location sensor also may be used to indicate on a display or computer system whether other container management systems are located nearby, and possibly generate a map showing the location or number of other users in a certain geographic region (e.g., in a park, building, neighborhood, city, etc.) The users shown in the map may be those previously identified as friends via some social network or other users regardless of whether they are known to the user. Also, in certain embodiments, a user may export the map or other indicator showing their own location to a social network.

A pressure sensor may be configured to detect and possibly cause a release in pressure when the pressure reaches a certain threshold or range. For example, if a soup or beverage is spoiling and causing release of gasses, thereby causing a build-up of pressure, the pressure sensor could detect this build up, and, possibly open a vent cover or vent valve to permit release of excess gas.

Any of the sensors may generate a sensor output, which includes detected information in digital or analog format. (If some detected information is in analog format, the system may include an analog to digital converter to facilitate such conversion.) The sensors, or another component in the system, may send the detected information to one or more of the computer elements. The sensors may communicate with the computer elements via any wired or wireless communication system known in the art. Some examples of a wireless communication system may include a system configured to implement Wi-Fi, Bluetooth, Zigbee, Near Field Communication, Infrared, ANT+, Wireless USB, Z-wave, IEEE Standard 802.15.4, IEEE Standard 802.22, RFID, or other short-range wireless communication technology, or long-range wireless communication technology.

The computer elements may convert the sensor output into a system output such as visual output (e.g., representations or light) to be displayed in a display element, audio output (e.g., sounds including tones, beeps, music, songs, words, etc.) to be produced by an audio output element, or tactile output (e.g., vibration) to be caused by a tactile output element. Also, one or more of the computer elements may send instructions back to the sensor, possibly regarding when to start or stop detecting information, when to send detector information to a computer element, instruction to turn on or off, or other information.

The container management system also may be configured to receive, store, or analyze non-detected information such as information input from an external source. Examples of such external source information include weather in the location near the user (as determined by the location sensor or user input of location); map information including vehicle/walking navigation information, site information for restaurants, water fountains, beverage vendors, retailers of container systems/container managements systems, and other places related to a product which may be used in or with the container system, and other system user location information (e.g., locate other users of the same type/brand of container system via a map display); restaurant information including a menu or price information (in addition to restaurant location information identified above); or standards information such as the standard temperature at which people usually wish to consume a beverage, standard temperature at which a beverage is too hot or too cold for safe consumption, standard time after which a beverage or other product is considered stale or otherwise no longer desirable, standard amount of beverage (e.g., water) considered as healthy or hydrated, standard amount of disposable water bottles used by consumers, standard cost of coffee at restaurant or coffee shop; standard amount of cardboard used in typical to-go coffee/tea cup, etc.

The system and methods of the present invention also may include certain action elements configured to cause some physical or chemical change to the retainer, lid, product, or other contents of the retainer. Action elements may be disposed in or on the retainer, lid, or both. Certain embodiments of an action element may be configured to be activated automatically, manually, or both. Examples of an action element include an open/close lid opening assembly, a lid removal assembly, a heating element, a cooling element, a stirring element, an inner compartment door element, a treatment element, or other.

An open/close lid opening assembly may be configured to block or unblock a lid opening according to whether the lid opening is open (unblocked) or closed (blocked). Certain embodiments of the open/close lid opening assembly are configurable to automatically open or close the lid opening in response information detected by one or more sensors or in response to a user input. Such "automatic" embodiments of an open/close lid opening assembly may include a motor configured to rotate a crank, which is in mechanical communication with an actuator element. The actuator element may be disposed to directly block or unblock the lid opening or may be configured to cause movement of a lever arm assembly, which is disposed to block or unblock the lid opening. Automatic embodiments of an open/close lid opening assembly may include a lid input element such as a touchscreen, touch surface (e.g., push button, capacitive surface), roller-ball, keyboard key, switch, or other element configured to permit a user to input information, such as settings of the automatic embodiments, into the system.

Other embodiments of the open/close lid opening assembly may be configured to permit opening or closing the lid opening manually. For example, such embodiments may include a push button, which, when depressed, is disposed to physically change the position of a lid opening obstruction element.

Overall, many configurations of an open/close lid opening assembly are possible and within the scope of the present invention.

Additional types of action elements are described below.

A lid removal assembly may be one or more components configured to automatically or manually disconnect the lid (either partially or completely) from the retainer or removably connect the lid to the retainer. As an example, in certain embodiments, a lid removal assembly may be configured to cause a lid hinged to a retainer to disengage from the retainer at all points except the hinge and may removably reconnect the lid and retainer as well. In another example, a lid removal assembly may be configured to completely remove a threadably connectable lid from a retainer.

A heating element may be a resistive heater, heating wire or coil, thermoelectric heater, or other type of heater configured to increase the temperature of the retainer, lid, product, or other contents of the retainer.

A cooling element may be a refrigerant, ice unit, fan, or other cooling mechanism configured to decrease the temperature of the retainer, lid, product, or other contents of the retainer.

A stirring element may be configured and disposed to mix a product or move around a product within the retainer. Examples of a stirring element include a stirring rod, a straw, a magnetic stirrer, a vibration unit, or other.

An inner compartment door element may be a wall section or flap configured to divide the retainer or lid into one or more separate compartments. Upon activation, the wall section or flap may be configured to automatically or manually change position to provide access or prohibit access to the compartment.

A treatment element may include a filtering element, ultraviolet element, other purifying element, flavor emitting element, fragrance emitting element, liquid conditioning element, cleaning element, or other treatment of the lid, retainer, product, or other contents of the retainer.

Certain embodiments of the system and methods of the present invention include one or more computer elements. Examples of computer elements include a processor, system memory, cache, system bus, chasses, fan, power source, basic input/output system (BIOS), hard disk drive, optical disk drive, non-transitory computer-readable medium, and USB or serial port.

Computer elements disposed in or on the lid or retainer are termed "internal computer elements," and computer elements that are generally separate from the lid and retainer are termed "external computer elements" for purposes of this application. A group of internal computer elements or a group of external computer elements may form an internal computer system or an external computer system, respectively, or "computer systems" generally. The system and methods of the present invention may include any type of computer system.

Examples of an external computer system include a desktop computer, laptop computer, netbook computer, personal digital assistant, tablet, smartphone, certain other types of cellular telephone, MP3 player, wearable computer unit (e.g., head-mounted unit such as a Google Glass® unit, computerized wristwatch, computerized glove, computerized shoe, e-textiles, etc.), or other handheld or personal computing device. Also, two or more external computer systems may be networked to form a cloud computing system.

Certain embodiments of the present invention may include additional components. For example, embodiments of the present invention may include a power source, such as a battery, capacitor, flywheel, RFID circuit, solar cell, generator (e.g., micro generator, thermoelectric generator, inductive generator, piezoelectric generator, etc.), or power plug (e.g., two prong, three prong, European standard). Embodiments of the present invention also may include a power distributor such as a lithium-ion power distributor.

Also, embodiments of the present invention may include a system output element, such as a lid output element configured to be physically integrated in the lid, a retainer output element configured to be physically integrated in the retainer, or an external computer output element, not configured to be physically integrated with the lid or retainer, but possibly configured to be physically integrated with or connected to certain external computer elements.

Examples of a system output element include a display element, an audio output element, or a tactile output element. A display element may be a touchscreen, non-touch display screen (e.g., LCD screen or LED screen), analog display element, projector, or a single or small group of light emitting diodes. (A user may access a user interface via a display element.) An audio output element may be any kind of speaker. A tactile output element may be a vibration element or other component configured to cause motion or tactile response of some other component.

Method embodiments of the present invention may include using a sensor to detect information (e.g., location, fill volume, access status of lid opening, etc.) about the lid, retainer, or contents of the retainer. Once certain information is detected, that detected information may be used, sometimes in conjunction with externally sourced information, to calculate or compile second level information—termed "calculated information"—that generally cannot be or was not measured directly by the sensors. Calculated information includes computed information and statistical information, each of which is described in more detail below. Sometimes, before or after a sensor is used to detect information, the sensor may be calibrated to a zero reading to promote accuracy.

Additional method embodiments of the present invention may include detecting a condition using a sensor and then, possibly, repeating the detecting step several times in a short period of time (e.g., a burst of multiple detection events in a short period of time such as a fraction of a second or a second). The sensor may send the information to an internal processor located in the container system, where the internal processor determines whether there is a significant difference between the readings received from the burst of detection events and calculates which reading (or mean or median of the readings) to send to an external processor (e.g., located in a smartphone). Alternatively, the one or more sensors may take a number of readings and an internal processor may receive multiple readings separated by a meaningful period of time (e.g., a fraction of a minute, 1 minute, 3 minutes, 5 minutes, 10 minutes, an hour, etc.). The internal processor may calculate the difference between the time-separated readings. The computed information may be sent to the external computer elements via wired communication system (e.g., USB cord) or wireless communication system (e.g., Wi-Fi, Bluetooth, Zigbee, Near Field Communication, Infrared, ANT+, Wireless USB, Z-wave, IEEE Standard 802.15.4, IEEE Standard 802.22, RFID, or other short-range wireless communication technology, or long-range wireless communication technology). The computed information may be sent to the external computer elements upon completion of the computation by the internal processor, at certain time periods, after a certain amount of information is gathered, or only if the computed information is different relative to the most recently generated computed information.

In certain embodiments, the internal computer elements send detected information that has not been processed (e.g., is raw), rather than computed information, directly to certain external computer elements.

Whether the transmitted information is processed or raw, the external computer elements may include an application software, a database, a system memory, or a whole computer system. (For purposes of this patent application, the term "application software" means a set of one or more programs executed by a processor designed to carry out operations for a specific purpose.)

Examples of information that may be detected or calculated by the container management system includes: total value or average of how much product has been consumed or otherwise dispensed from the retainer over a certain period of time (e.g., an hour, a day, time since user started a timer, time since container system first used, a current time period, an earlier time period); how long the product is within certain temperature ranges and related averages; current status (e.g., temperature or volume) of product in retainer; current status or historical status of lid opening (e.g., open or closed); current status or historical status of retainer (e.g., tipped over or upright); number of times retainer has been refilled; current or historical geographic location of retainer or lid; how often, for how long, and where the container system is used; resources (e.g., paper, plastic, money) saved by using container system compared to using a disposable water bottle or disposable restaurant to-go cup; how strong a signal is received from an external computer system or external computer element; etc.

The detected information and/or calculated information may be stored in an external computer element (e.g., system memory possibly part of a smartphone or an application software) or an internal computer element (e.g., internal system memory possibly part of the container system) or other system location.

In addition, the detected information or computed information (which may include volume information, temperature information, and container system use information, any of which may also include the respective times of detection) may be further analyzed to provide additional statistical information. For example, a user (e.g., restaurant owner or franchise owner) may aggregate the detected information to generate statistics on how long after brewing coffee is typically served, how much coffee is served during optimal period after brewing, how long after brewing coffee is typically discarded, how much coffee is brewed and then discarded, whether and how often franchisee complies with certain guidelines for beverage service, or what times (in a day, month, or year) is coffee or water consumed and in what quantities. A user also may cross reference the volume information or volume/time information with its sales information to see whether the dispensed amounts and rates match the sales amounts and rates. Any statistical information may be organized and displayed by a selected time period, a pre-set time period such as an individual shift (e.g., 9 am to 3 pm, 3 pm to 11 pm) or business quarter, or tied to an entity such as an individual employee or manager, restaurant, franchisee, or an entire franchise. Clearly, certain embodiments may be adapted to permit a restaurant manager or franchisor to quickly obtain, calculate, and manage certain information about volume, temperature, and time measurements related to beverage dispensing or consumption.

Also, the detected information, calculated information, or statistical information also may be sent from a first external computer element such as the application software to, for example, a second external computer element such as a second application software. In one example, the detected information may be the volume of liquid in a retainer measured at a number of time points. The calculated information may be the amount of liquid that a user presumably consumed based on the detected volume measurements. The statistical information may be a comparison of the liquid consumed over a time period vs. a recommendation or goal for consumption of liquids or that liquid (e.g., water consumed vs. doctor recommended water intake or water consumption goal). Any of this information may be sent from a sensor or internal computer elements to a first application software (e.g., an application software executed by processor and configured specifically for communication with the internal computer elements), which then may be sent to a second application software (e.g., an application software configured to collect or store general health-related information from multiple sources).

The system also may permit the user to view the detected information, calculated information, or statistical information from an external computer system that may be in a remote location. (For purposes of this application, the term "remote" means spaced apart, not physically touching, but does not require any specific distance.) For example, if a user wishes to identify the temperature of contents in a retainer, the user could access their smartphone and obtain a reading via the user interface. If desired, the user could send instructions for the container management system to close the lid opening to maximize hot temperature retention or open the lid opening to permit cooling.

Detected information also may be illustrated as a representation in the display element via the user interface (the user interface is possibly part of an application software). In certain embodiments, the representation illustrates the current status (e.g., the most recently detected information), which is updated generally in real-time or as close to real-time as possible. In other embodiments, the representation is updated only at certain time intervals or illustrates a set of detected information gathered over time. A representation may illustrate information obtained from a single sensor, multiple sensors of the same type, multiple different kinds of sensors, or one or more sensors combined with one or more external data sources. Examples of a representation include a stylized numeric value of detected information, written description of detected information, or symbol or code (e.g., drawing of fire to indicate "hot" status or ice/snow to indicate "cold" status; diagram showing lid removed from retainer or lid opening as closed; picture showing relative amount of product in retainer; skull to indicate dangerous condition; clock to show time of event or current time; visual depiction of retainer or type of retainer, color coding for temperature, content type, or volume information), graph (e.g., bar graph, pie graph, line graph, etc.), or infographic (e.g., group of drawings possibly with text). Two or more representations may be created to show two or more sets of detected information.

In addition, if the detected information includes some notice-triggering information, the user interface may provide a notification such as a push notification, email, text message, alert, alarm, change in representation on display element, or other message configured to communicate that notice-triggering information to the user. Examples of notice-triggering information may include that the temperature of the retainer or retainer contents have reached a certain temperature (for example, the temperature at which the contents may have less appeal (e.g., tea or coffee is too cold) or have more appeal (e.g., tea or coffee is cool enough to minimize burn hazard); certain period of time has passed (e.g., coffee in coffeepot has sat out too long and become too bitter or over-oxidized; tea bag should be removed after ideal steeping time; replace filter element after so many refills).

The user interface also may be configured to permit the user to enter, track, or predict information related to a container system or its likely contents. For example, a user interface may permit entry of goals about hydration (e.g., drink certain number of ounces of water per day) or caffeine reduction (e.g., limit amount of coffee/tea consumed per day). A user interface may also be configured to permit entry of goal-determining information (e.g., age, weight, sex, weight loss plans, diet, lifestyle activity level, exercise activity level, home location, altitude, weather, current hydration level), which may permit the system to estimate an appropriate goal (e.g., hydration goal) for the user. Also, a user interface may be configured to permit the user to track consumption of beverages or food for dieting, hydration, blood sugar regulation, insulin regulation, or other purposes, or, for example, tracking consumption of medication, calories, or carbohydrates.

In addition, a user interface may be configurable to display predictions of when a beverage will reach a certain temperature if certain actions are taken (e.g., lid remains on retainer with drink opening closed, lid used in line with typical user use, container system put in a specific temperature environment such as outdoors or refrigeration unit).

A user interface also may include a rewards element. A rewards element may permit delivery of rewards (e.g., points or coupons) after a user has logged or the system detects certain reward-worthy-events. Examples of reward-worthy-events include achieving a certain number of refills, a certain volume of liquid consumed or otherwise dispensed, a certain number of visits to a gym, or a certain goal is achieved once or multiple times.

Embodiments of the user interface (and computer system) also may be configured to permit the user to export information to a secondary format such as a word processing document, a spreadsheet, a facsimile, an email, a text message, a social media post (e.g., Facebook post, Twitter post, Instagram post, Tumblr post, LinkedIn post), or other secondary format known in the art.

A user interface also may include a manufacturer or retail element configured to permit a user to easily contact (e.g., via email, system message, text message, webpage, etc.) a retailer or manufacturer of a container system or container management system.

Certain embodiments of the system and methods are configured to permit a user to monitor and manage one or more than one container system. Such embodiments may permit assigning a name or title to each container system in the user interface. Also, embodiments of the present invention may be configured for personal use (e.g., one user manages their personal water bottle and personal insulated mug), for family use (e.g., one user manages personal mug, spouse's tumbler, plus kids' water bottles), for restaurant or business use (e.g., one or more users manage multiple coffee pitchers/pump pots at a restaurant or business location), or for franchise use (e.g., franchise owner can track and review coffeepot volume/refill/temperature/cleaning information at various locations).

One object of certain embodiments of the present invention is to permit a user to manage one or more container systems or components thereof.

Another object of certain embodiments of the present invention is to automatically close a lid opening upon detecting certain sensor detected information. For example, certain embodiments of the present invention may be configured to automatically close a lid opening upon detecting certain spilling conditions such as the associated retainer is falling over or otherwise is in a spilling orientation. As another example, certain embodiments of the present invention may be configured to automatically close a lid opening upon detecting a temperature is above or below a certain threshold temperature or within a certain undesirable temperature range (e.g., threshold temperature or temperature range may be set by user or by manufacturer).

Another object of certain embodiments of the present invention is to automatically open a lid opening upon detecting certain sensor detected information. For example, certain embodiments of the present invention may be configured to automatically open a lid opening upon detecting certain "drinking" conditions such as the associated retainer is in a drinking orientation, the user's lips are touching a lid surface, or the temperature is within a certain temperature range or above or below a certain threshold temperature. Drinking conditions may be identified by detecting the orientation, the speed with which the orientation was reached, the speed of travel, whether the orientation is typical for drinking (e.g., if the drinking opening is off-center the user would typically orient the beverage container in such a manner that the beverage travels the least distance to reach the user's mouth), whether the a person's lip is touching a lid surface, the temperature of the beverage, other information detected by the sensors, a combination of information gathered by the sensors, or user input information.

Another object of certain embodiments of the present invention is to permit a user to identify the geographic location of a container system (for example, to facilitate finding a lost container system).

Another object of certain embodiments of the present invention is to permit a user to detect, track, record, review, and communicate information about a container system or its contents.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denote like elements, and in which.

DETAILED DESCRIPTION OF EMBODIMENTS OF THE INVENTION

For purposes of this application, certain embodiments of the present invention described and illustrated herein are directed to container systems configured specifically to contain beverages, but the discussion is merely exemplary. The present invention is applicable to any type of container system known in the art.

Also for purposes of this application, any terms that describe relative position (e.g., "upper", "middle" "lower", "outer", "inner", "above", "below", "bottom", "top", etc.) refer to an embodiment of the invention as illustrated, but those terms do not limit the orientation in which the embodiments can be used.

Figure 1A:
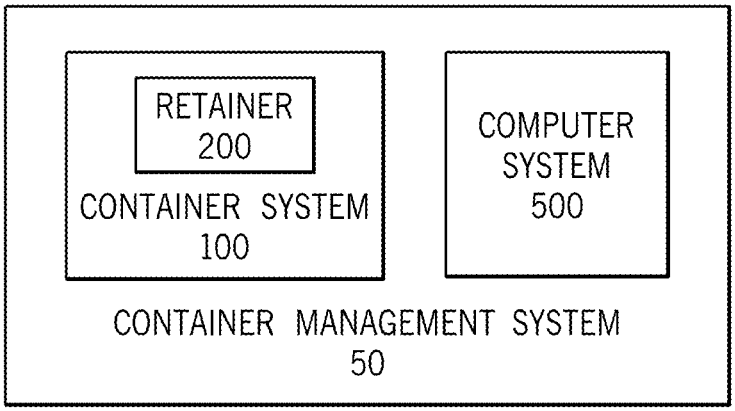
FIG. 1A illustrates a general depiction of an embodiment of a container management system.
Figure 1B:
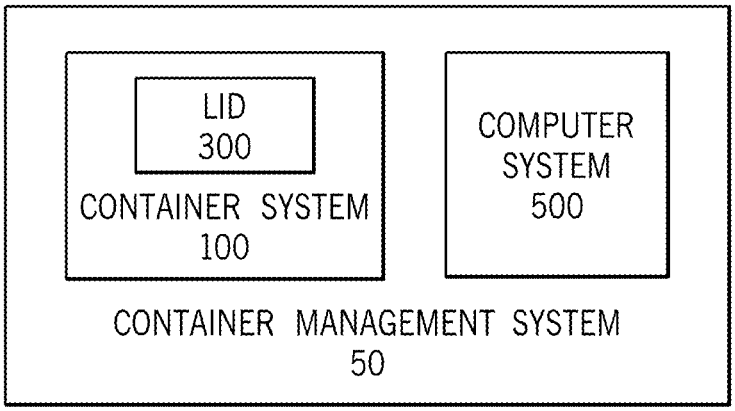
FIG. 1B illustrates a general depiction of another embodiment of a container management system.
Figure 1C:
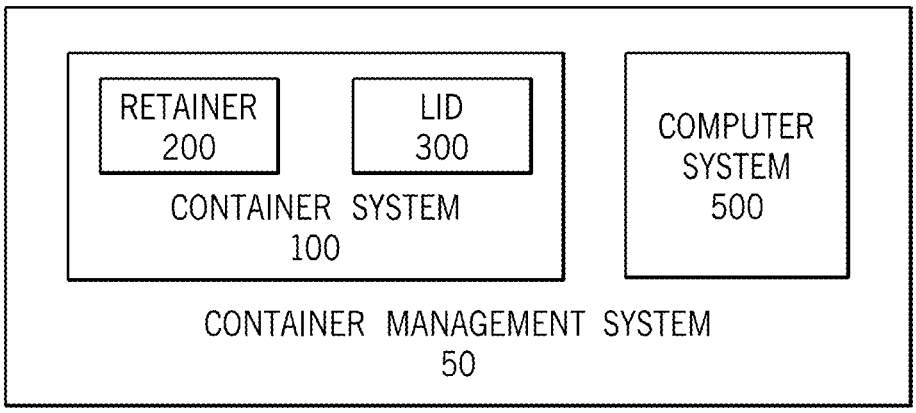
FIG. 1C illustrates a general depiction of an additional of a container management system.
Figure 1D:
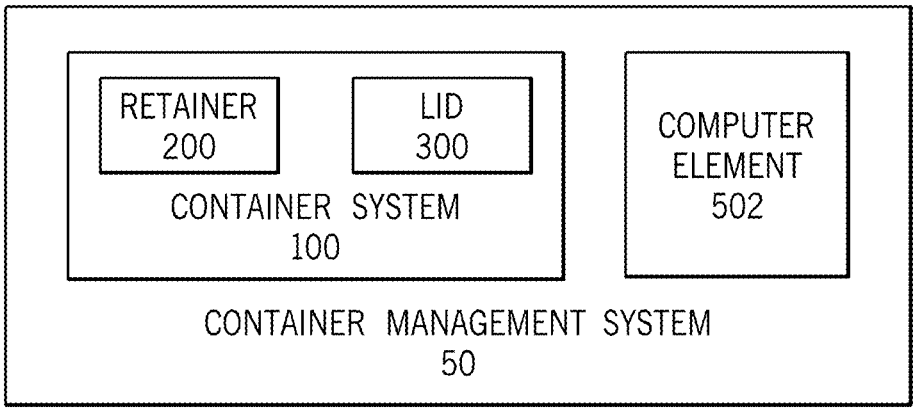
FIG. 1D illustrates a general depiction of yet another embodiment of a container management system.
Figure 1E:
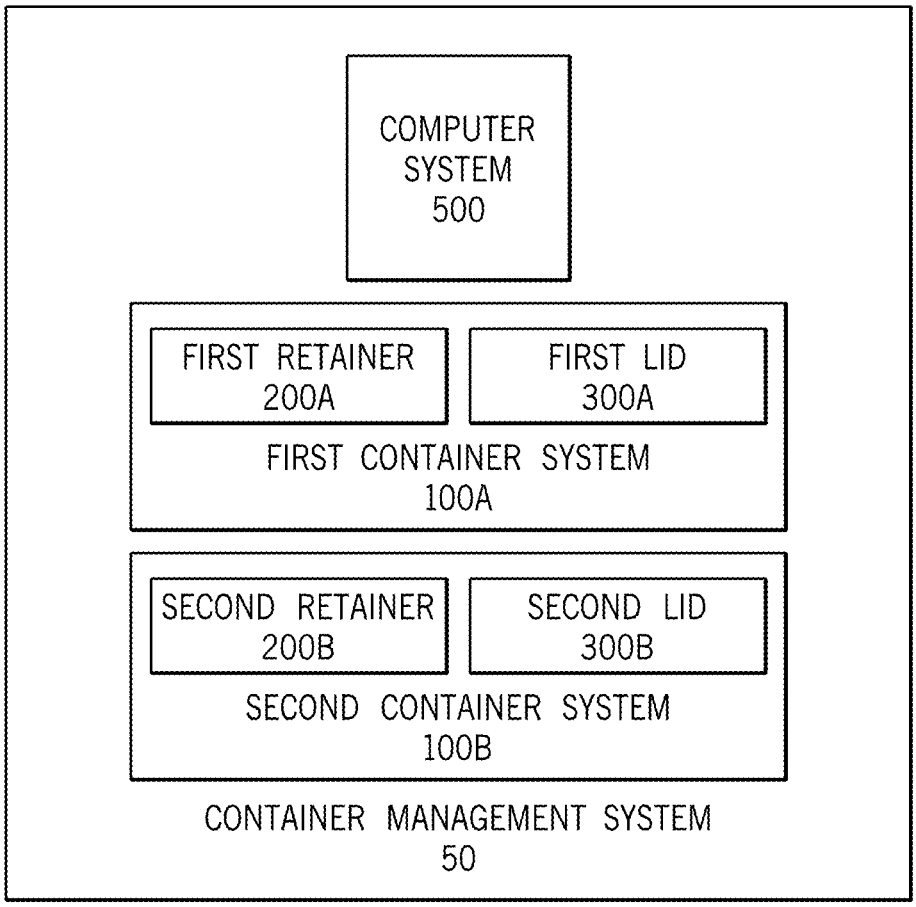
FIG. 1E illustrates a general depiction of an additional embodiment of a container management system.

FIG. 1A-FIG. 1C include simplified illustrations of certain general system embodiments of the present invention. Such embodiments include a container management system 50 having a container system 100 and a computer system 500. In the embodiment illustrated in FIG. 1A, the container system 100 is a retainer 200. In the embodiment illustrated in FIG. 1B, the container system 100 is a lid 300. In the embodiment illustrated in FIG. 1C, the container system 100 is comprised of a retainer 200 and a lid 300. The embodiment illustrated in FIG. 1D includes one or more computer elements 502 rather than an entire computer system 500. The embodiment illustrated in FIG. 1E includes computer system 500, a first container system 100A (having a first retainer 200A and a first lid 300A) and a second container system 100B (having a second retainer 200B and a second lid 300B).

Figure 2A:
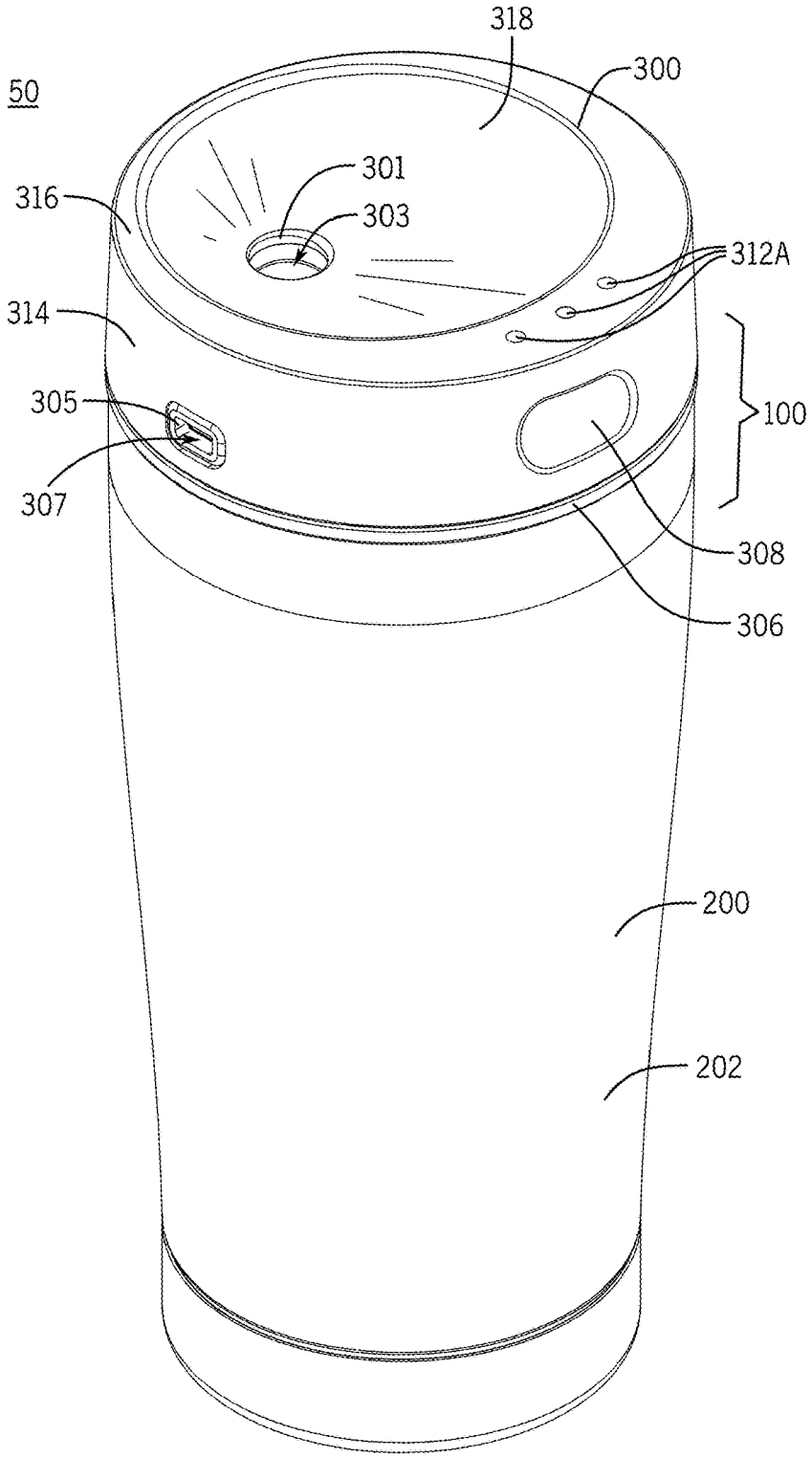
FIG. 2A illustrates a side perspective view of an embodiment of a container management system including a lid and a retainer.
Figure 2B:
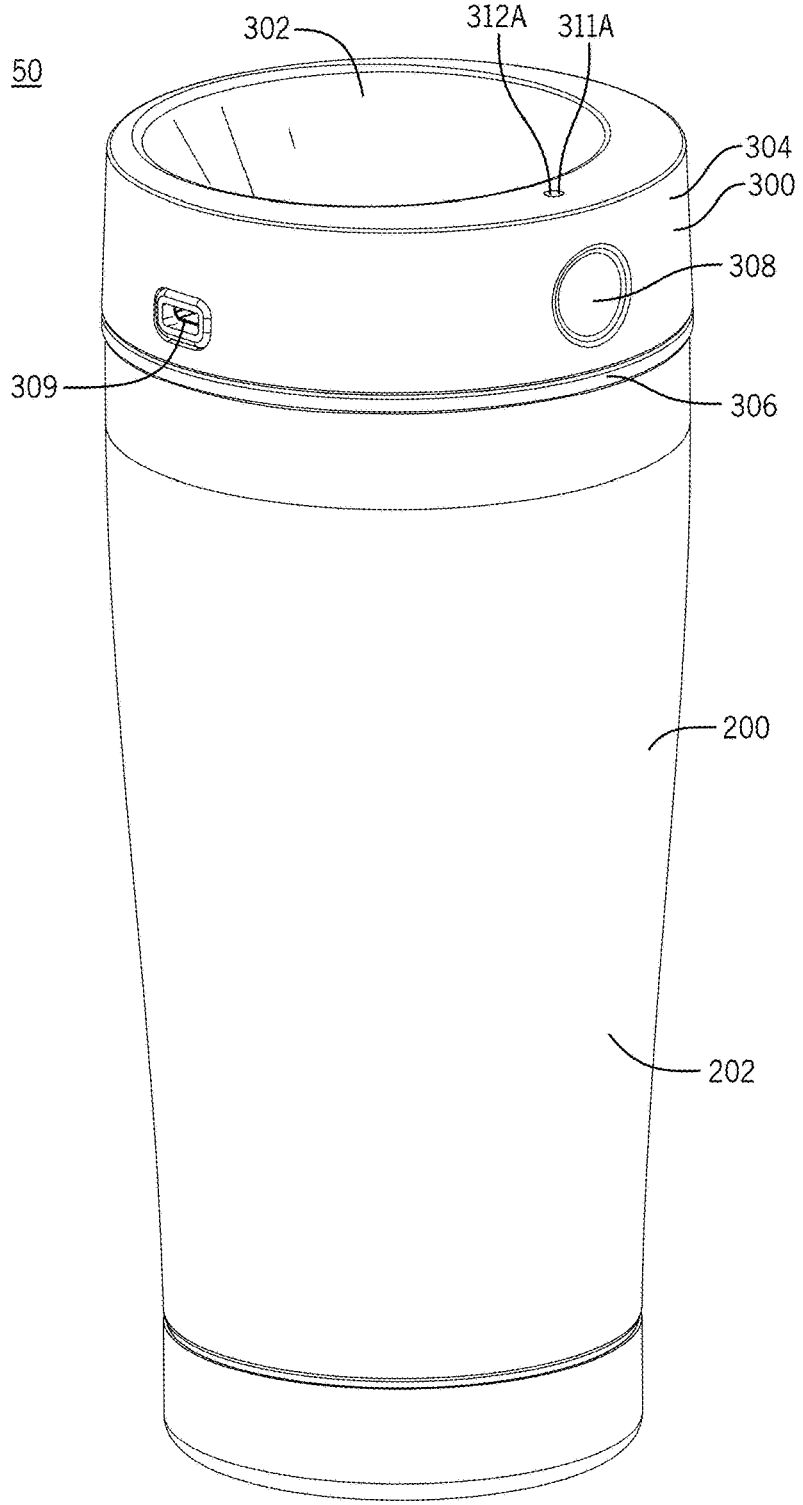
FIG. 2B illustrates a side perspective view of another embodiment of a container management system including a lid and a retainer.
Figure 3A:
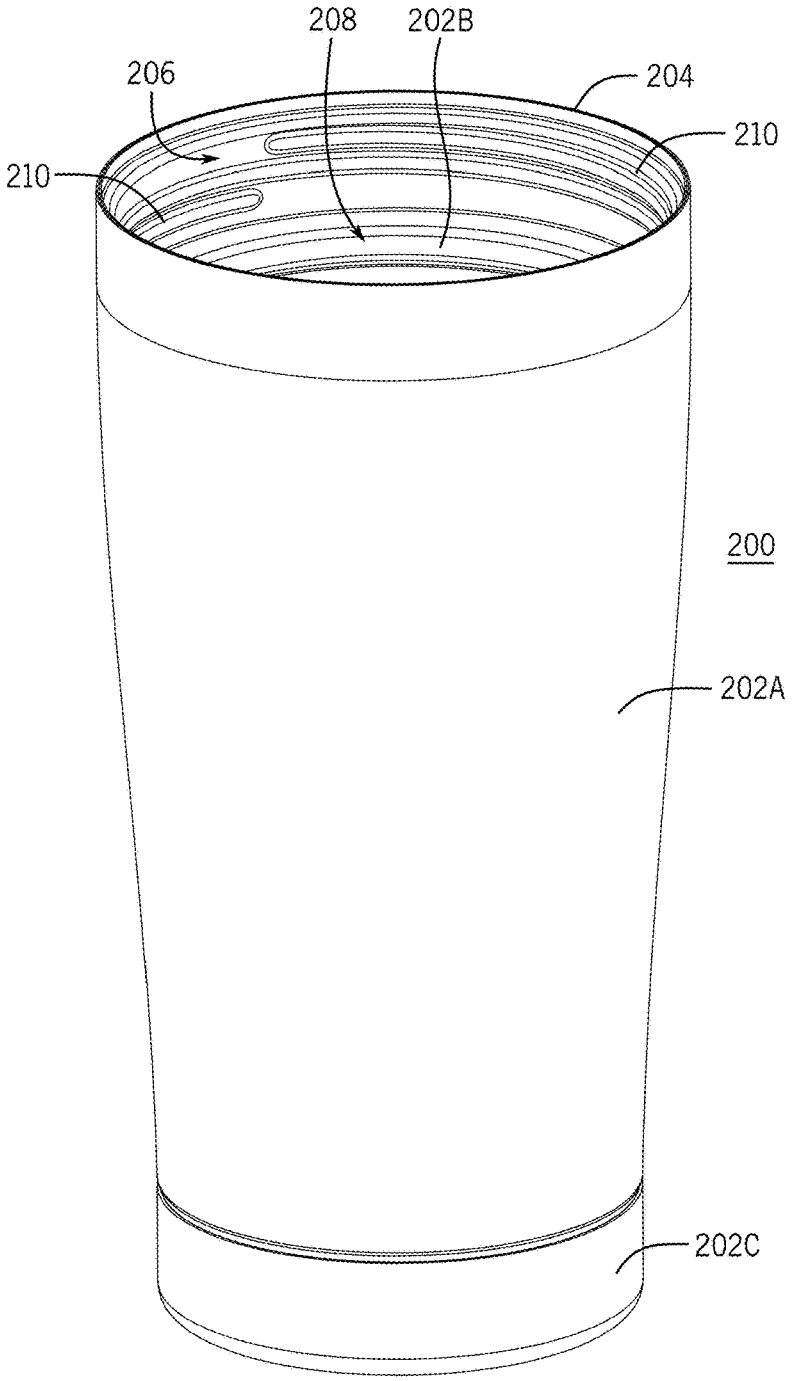
FIG. 3A illustrates a side perspective view of an embodiment of a retainer.
Figure 3B:
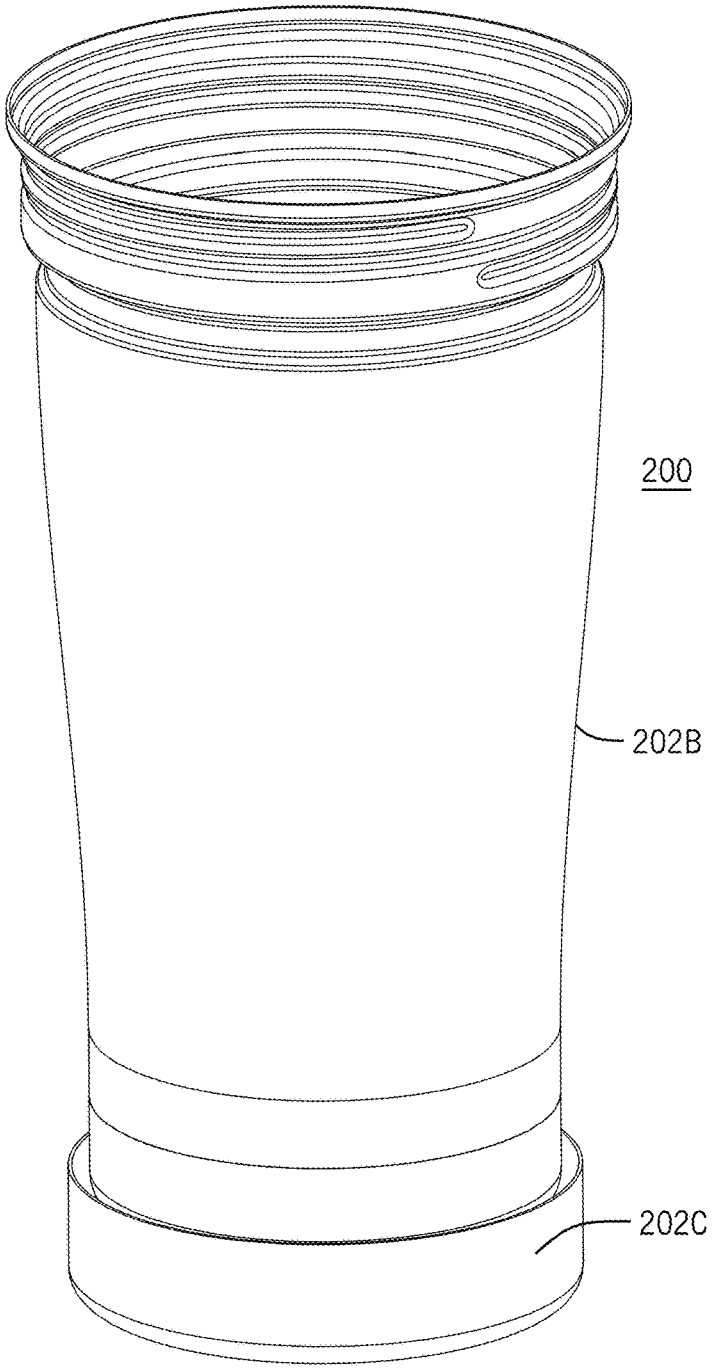
FIG. 3B illustrates a side perspective view of an embodiment of portions of a retainer.

FIG. 2A and FIG. 2B illustrates a container system 100 including a retainer 200 and a lid 300. FIG. 3A and FIG. 3B illustrate a retainer 200 without a lid. The retainer 200 includes a retainer body 202 configured to receive a product. With general reference now to FIG. 2A, FIG. 2B, FIG. 3A, and FIG. 3B and initially FIG. 2A, the illustrated retainer body 202 includes an outer retainer body 202A, an inner retainer body 202B, and a base retainer body 202C. The retainer body 202 may terminate at a retainer edge 204, which generally defines a retainer opening 206. A retainer opening 206 may be sized and shaped to permit inserting or pouring a product into the retainer space 208. The illustrated retainer 200 is configured to removably connect to a lid 300 via a set of complementary retainer threads 210 corresponding to a set of complementary lid threads 310, but embodiments of the retainer 200 may have any complementary elements configured to facilitate a removable connection between the retainer 200 and the lid 300.

Figure 2C:
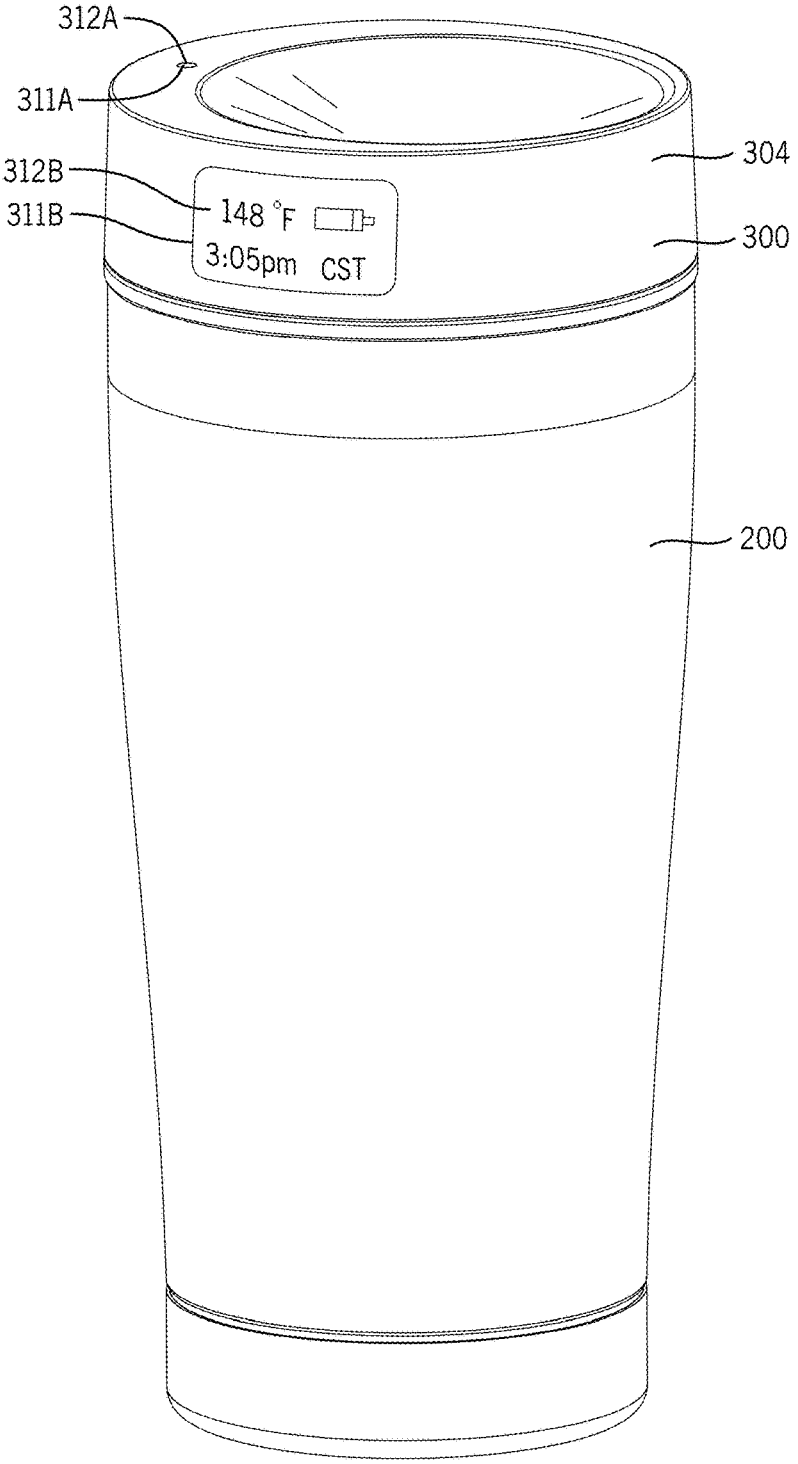
FIG. 2C illustrates a side perspective view of an additional embodiment of a container management system including a lid and a retainer.
Figure 4A:
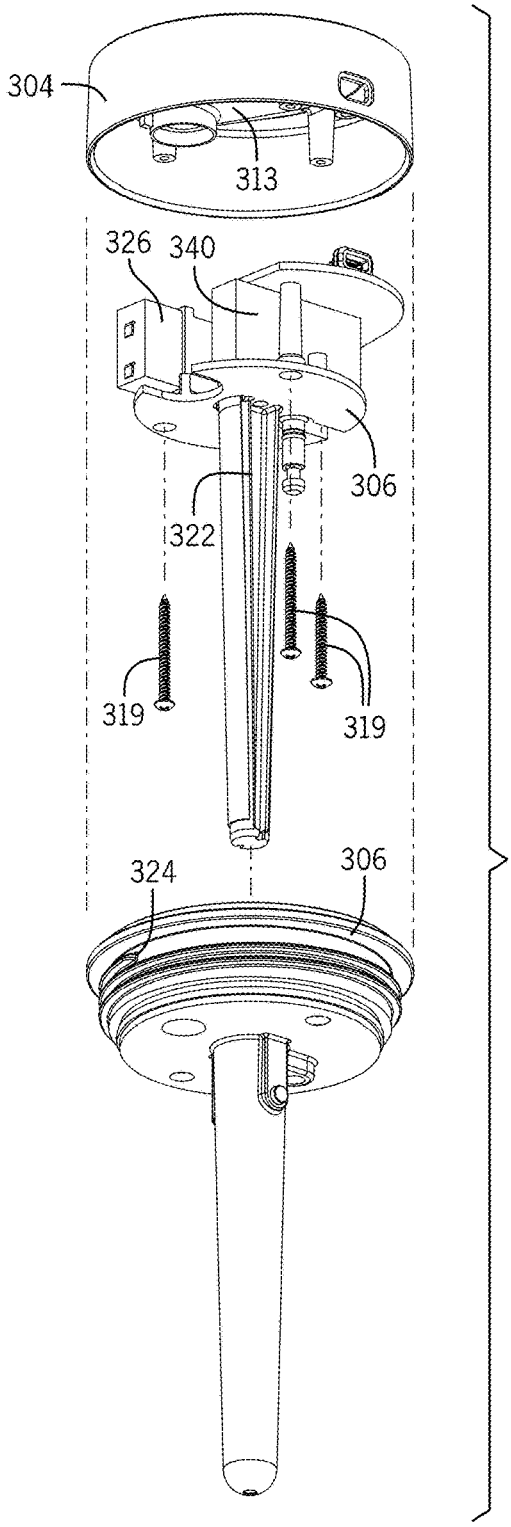
FIG. 4A illustrates an exploded isometric view from below of an embodiment of a lid.

The lid 300 is configured to permit dispensing or releasing the product out of the retainer space 208 without removing the lid 300 from the retainer 200. The lid 300 includes a lid body 302 having a lid shell element 304 and a lid support element 306. (An embodiment of a lid support element is shown in FIG. 4A, and is discussed in more detail below.) The lid shell element 304 has a first lid edge 301 defining a first lid opening 303 configured as a drink aperture. The lid shell element 304 also has a second lid edge 305 defining a second lid opening 307 configured as a computer element aperture, specifically, a USB port aperture sized and shaped to fit a USB port 309. The lid shell 304 also may include a third lid edge 311A or 311B defining a third lid opening configured as a display element aperture. The display element aperture may be sized and shaped to fit a first display element 312A such as a light emitting diode (LED) shown in FIG. 2B or a second display element 312B such as a display screen shown in FIG. 2C.

The lid shell element 304 generally forms the uppermost or outermost part of the lid 300. A lid shell element 304 may include a lid side wall 314, a lid rim wall 316, and a lid top wall 318. The lid side wall 314 may include a lid input element 308 configured as a touch surface. The lid top wall 318 may have a generally frustoconical shape or a funnel shape in which the lid opening 303 is off-center and generally at the bottom of the funnel shape.

As shown in FIG. 4A, a lid support element 306 is configured to provide structural support for certain other elements of the system, if present, such as sensors, action elements, or computer elements. The illustrated lid support element 306 includes an inner frame element 322 (shown in FIG. 4B in isolation and shown in FIG. 4C and FIG. 4D with certain other components) and an outer frame element 324 (shown from a top perspective view in FIG. 5A and a bottom perspective view in FIG. 5B). When the components are positioned for use, the outer frame element 324 generally surrounds the inner frame element 322.

Figure 6A:
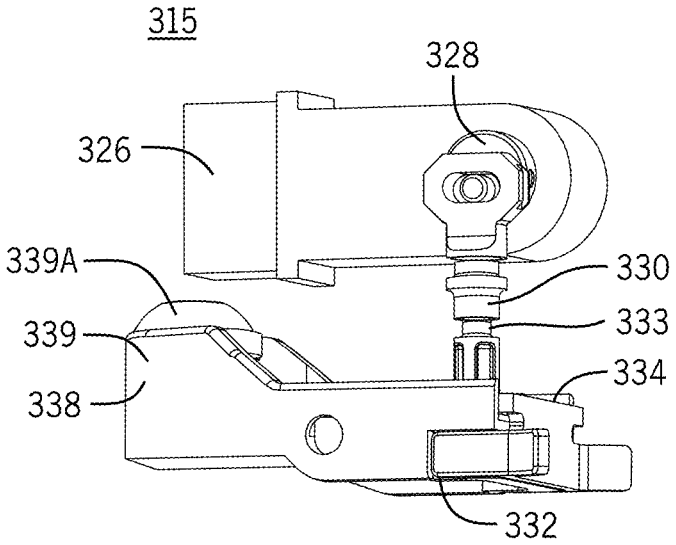
FIG. 6A illustrates a side view of an embodiment of an open/close lid opening assembly.
Figure 6B:
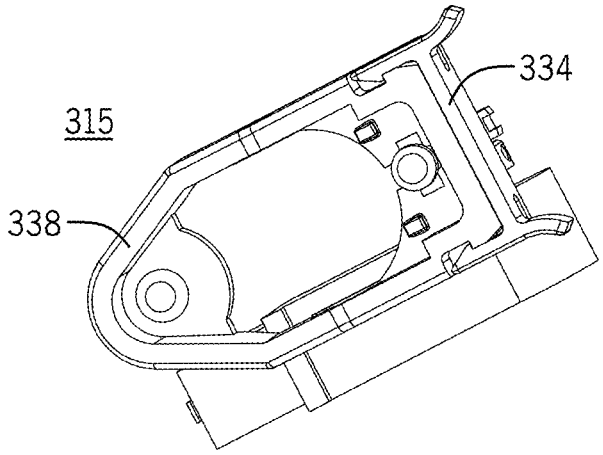
FIG. 6B illustrates a bottom view of an embodiment of an open/close lid opening assembly.

In the illustrated embodiment, the upper inner frame element 322A is configured to support one or more components of an open/close lid opening assembly 315. The illustrated embodiment of an open/close lid opening assembly 315 (also shown apart from the upper inner frame element 322A in FIG. 6A) includes a motor 326 configured to rotate a crank 328, which is in mechanical communication with an actuator element 330. The actuator element 330 is configured to cause movement of a lever arm assembly 332, which is disposed to block or unblock the drink aperture or other lid opening. Upon activation of the motor 326, the crank 328 rotates, causing the actuator element 330 to move, for example, downward. The downward movement of the actuator element 330 causes the actuated side 334 of the lever arm assembly 332 to also move downward. Because the lever arm assembly 332 is mounted on one or more fulcrum ridges 336 on the outer frame element 324 (see FIG. 7), moving the actuated side 334 downward causes the opposite side—that is, the aperture blocking side 338—to move upward and block the drink aperture itself or block the entrance to the product tube 350 leading to the drink aperture. The aperture blocking side 338 may include an aperture blocking configuration 339, for example, a sealing element 339A (e.g., a rubberized or flexible stopper unit).

To unblock the drink aperture (or other lid opening), the motor 326 is activated (e.g., by a lid input element, push button, or computer system) to rotate the crank 328, causing the actuator element 330 to move, for example, upward. The upward movement of the actuator element 330 causes the actuated side 334 of the lever arm assembly to also move upward. When the actuated side 334 moves upward, the aperture blocking side 338 is lowered such that it is no longer physically blocking the drink aperture or the entrance to the product tube 350 leading to the drink aperture. In addition, the body of the illustrated actuator element 330 is sized and shaped, possibly with a vent indentation 333, such that when the actuator element 330 is positioned to unblock the drink aperture, a vent path is open to permit release of pressure from the retainer space during drinking or pouring.

Figure 8A:
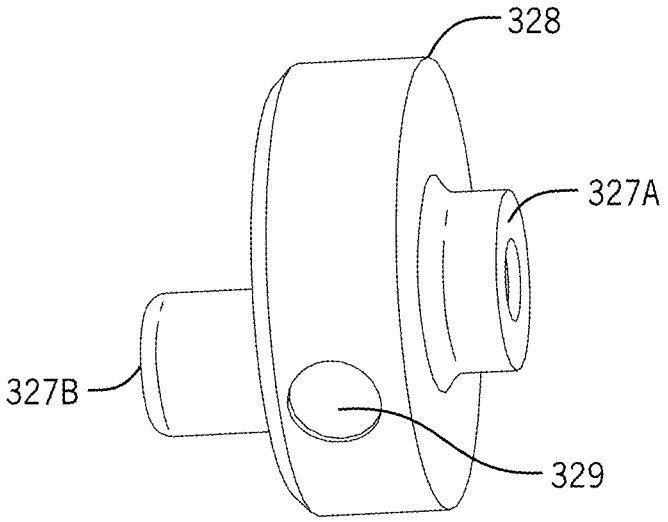
FIG. 8A illustrates a profile perspective view of an embodiment of a crank.
Figure 8B:
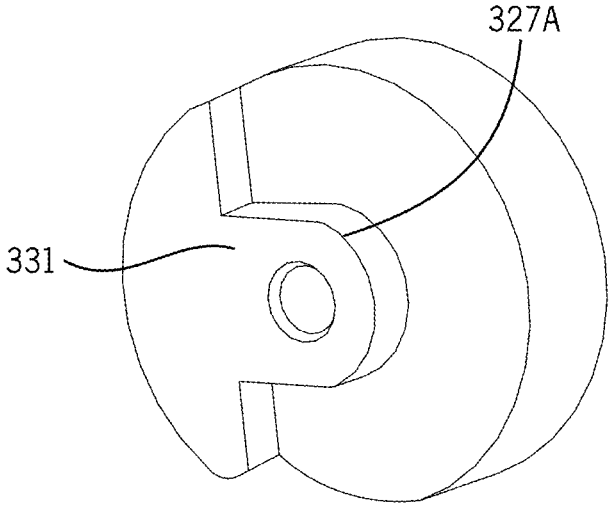
FIG. 8B illustrates a side perspective view of an embodiment of a crank.

In certain embodiments, the crank 328 includes one or more crank magnets 329 shown in FIG. 8A, which permit a magnet sensor to detect the status or orientation of the crank (and therefore, calculate the orientation of the other components in the open/close lid opening assembly 315). For example, if a crank magnet 329 is close by the magnet sensor, the lid opening may be known to be blocked/closed. If the crank magnet is rotated away from the magnet sensor, the lid opening may be known to be unblocked/open. The crank 328 may include a motor interface element 327A and an actuator interface element 327B. As shown in FIG. 8B, the motor interface element 327A may include a stop configuration element 331 to impede the crank 328 from rotating past a certain point.

In certain embodiments, the open/close lid opening assembly 315 may be configured to partially block the lid opening such that the flow rate of the beverage may be controlled or to completely block the lid opening such that beverage is generally completely impeded from passing through the lid opening.

Figure 4B:
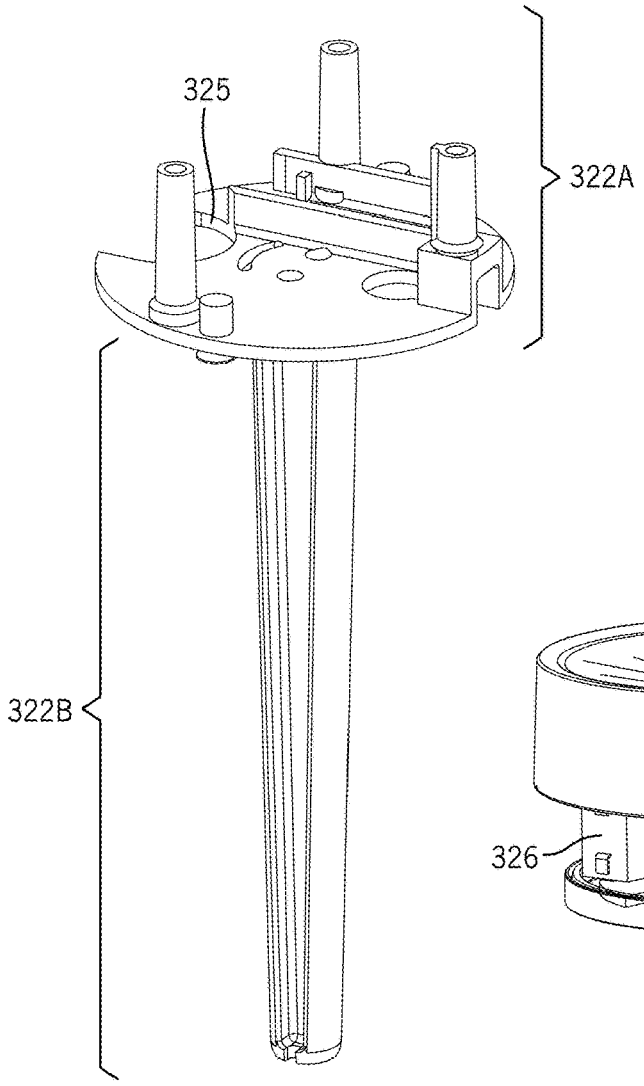
FIG. 4B illustrates a side perspective view of an embodiment of an inner frame element.
Figure 4C:
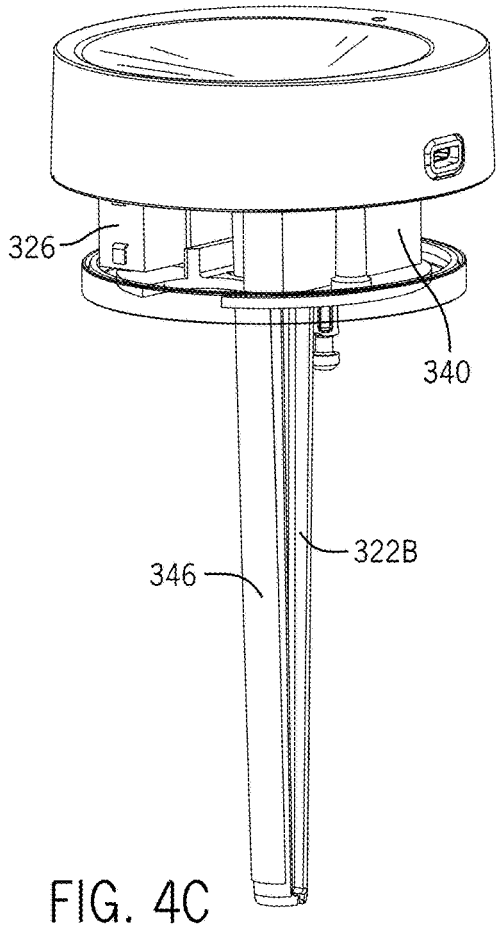
FIG. 4C illustrates a side perspective view of an embodiment of an inner frame element, a lid shell element, and certain additional components of a container management system.
Figure 4D:
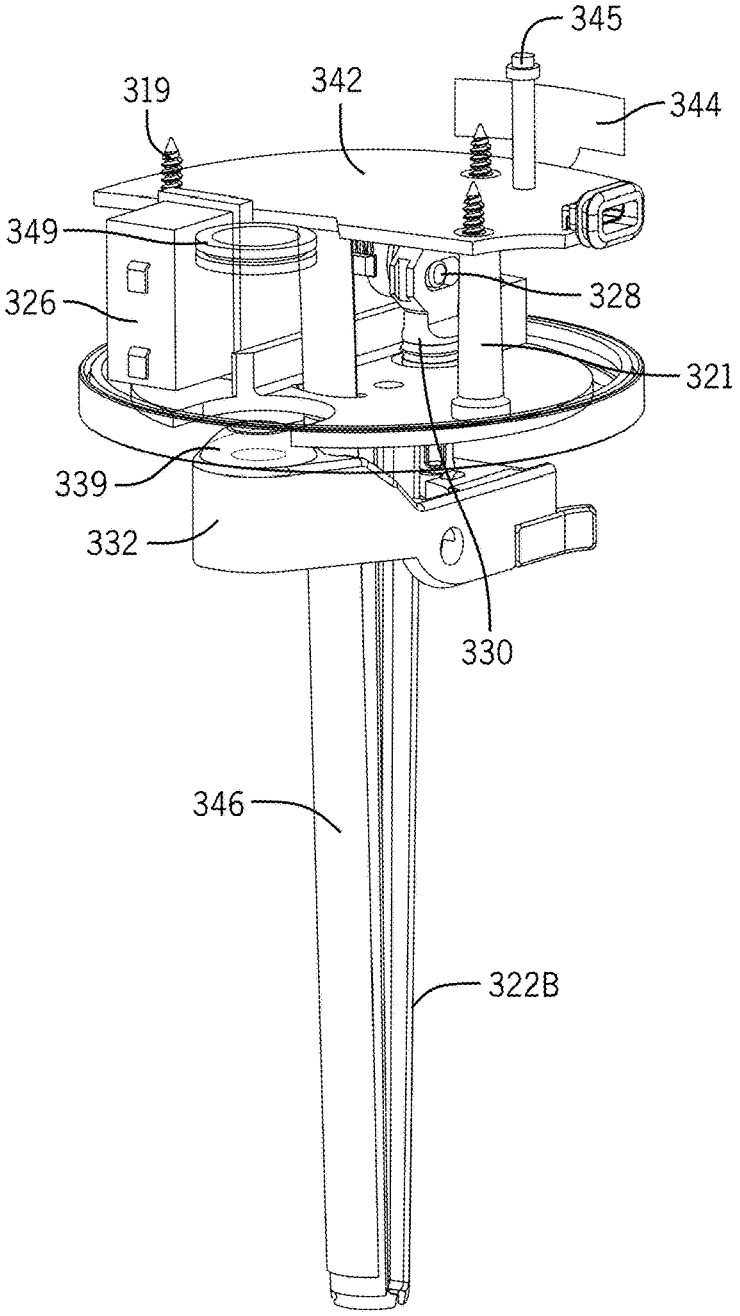
FIG. 4D illustrates a side perspective view of an embodiment of an inner frame element, a lever arm assembly, and various other components of a container management system.

As shown in FIG. 4B, the upper inner frame element 322A may include a cut-out section 325 to permit a product tube 350 to pass therethrough. Also, the upper inner frame element 322A may provide support for a power source 340 such as the battery as illustrated in FIG. 4C. In addition, the upper inner frame element 322A may provide support for a small computer system 500 or various computer elements 502. As shown in FIG. 4D, an integrated circuit board 342 (which may contain at least a processor and system memory) may be secured to the upper inner frame element 322A via securement elements 319 shown as screws in the illustrated embodiment. However, other examples of securement elements include nails, bolts, staples, complementary hook and loop components, adhesive, and other known in the art. The upper inner frame element 322A may include one or more securement element holders 321.

Also, adjacent to or affixed to the integrated circuit board 342 is a user input receiver 344, which is disposed to sense any input from the lid input element 308 on the lid side wall 314. In the illustrated embodiment, the user input receiver 344 is an upper portion of a flexible printed circuit board. In addition, a light pipe element 345 may be disposed to enclose or position a display element such as an LED such that the user can see, for example, whether the LED is on or off or a certain color from outside of the lid 300. The color or on/off/blinking status of an LED may indicate: whether the container management system is on or off; whether the lid opening is blocked or unblocked; whether any information is being detected by a sensor; whether certain information has been detected by a sensor (e.g., low volume of liquid in retainer or temperature is out of the comfort/safety zone for consumption); whether the open/close lid opening assembly is locked (e.g., cannot change position) or unlocked (e.g., can change position automatically upon detecting spill conditions or drinking conditions); whether there is a notification present (e.g., near a water fountain, met or near meeting a goal, reminder to refill or consume more/less); whether there is a warning (e.g., too hot to consume, bad weather approaching); whether the container system is has sufficient power or low battery; whether the container system is connected to an external computer system; or some other information.

The lower inner frame element 322B supports a lower portion of the flexible printed circuit board which may be configured to operate as a volume sensor 346. The lower inner frame element 322B and the volume sensor 346 are sized and shaped such that when the lid 300 is connected to the retainer 200, at least some portion of the volume sensor 346 extends into the retainer space 208. In certain embodiments, the volume sensor 346, lower inner frame element 322B and lower outer frame element 324B may be configured to extend into the bottommost portion of the retainer space 208 or may be configured to extend only into the middle or upper portions of the retainer space 208. More specifically, the lower inner frame element 322B or lower outer frame element 324B may be configured to extend through one quarter, one half, three-quarters, five-sixths, or the entire retainer space 208 by height.

Figure 5A:
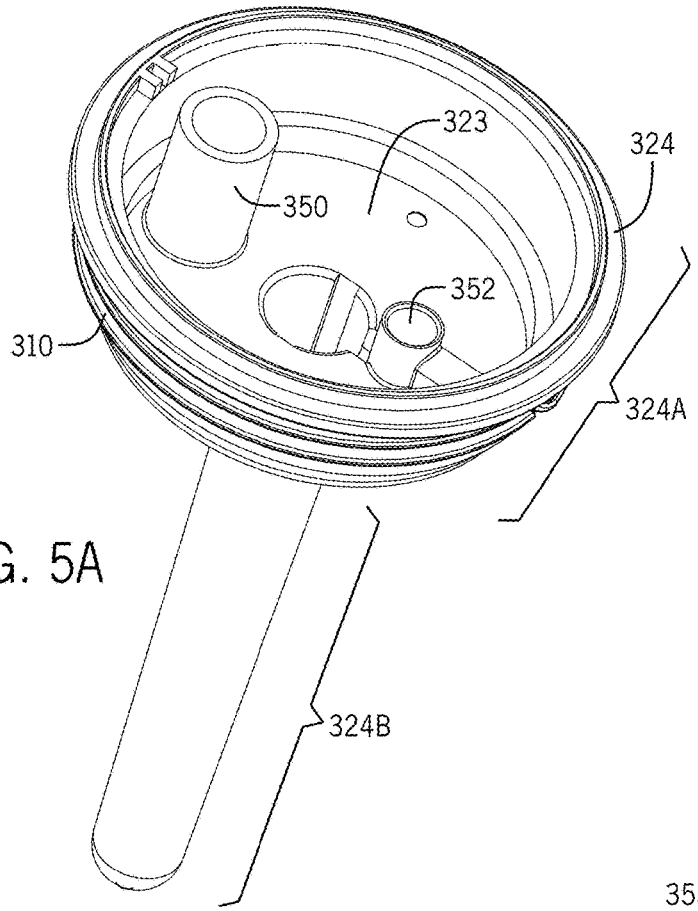
FIG. 5A illustrates a top perspective view of an embodiment of an outer frame element.
Figure 5B:
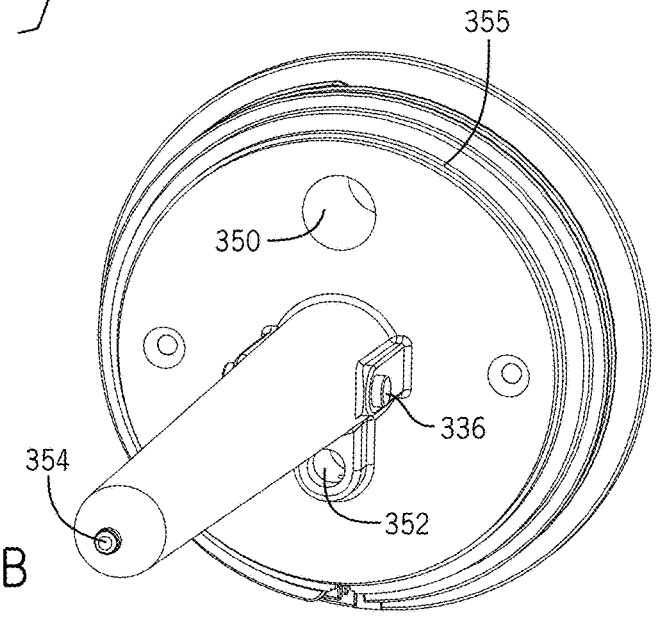
FIG. 5B illustrates a bottom perspective view of an embodiment of an outer frame element.
Figure 5C:
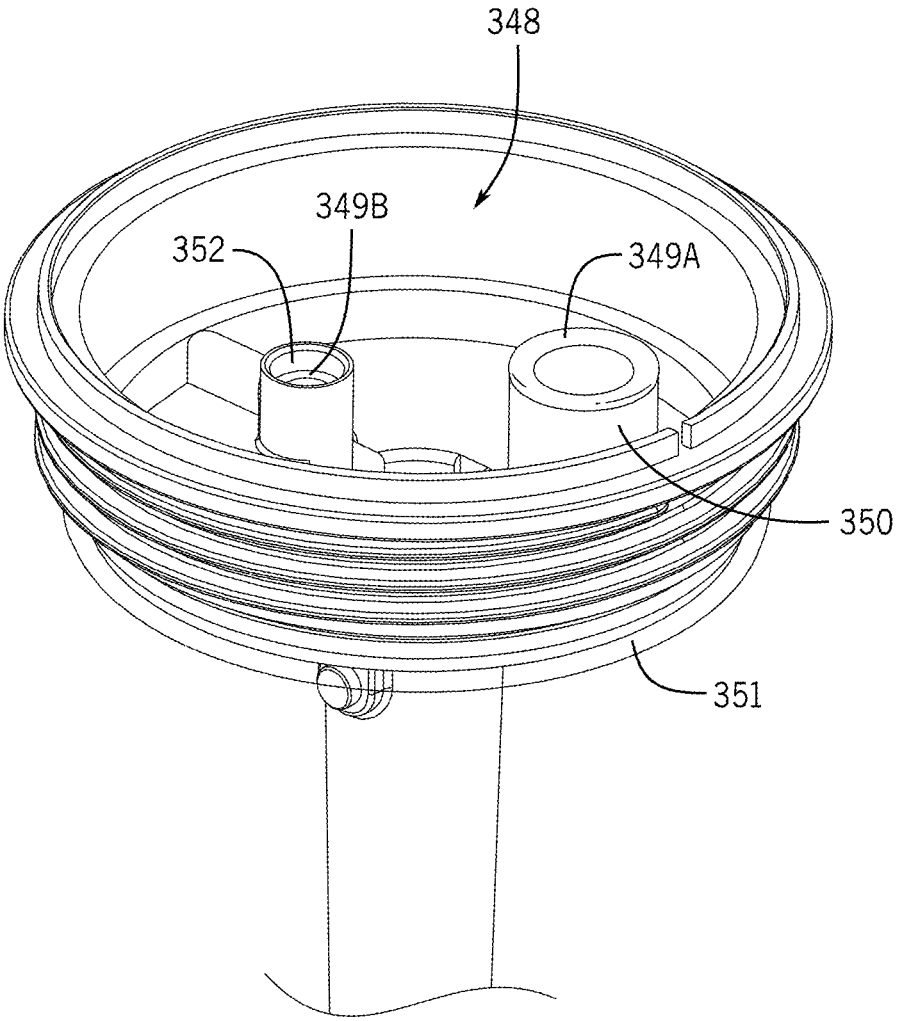
FIG. 5C illustrates a top perspective view of an embodiment of part of an outer frame element.

FIG. 5A and FIG. 5B illustrate an outer frame element 324. The interior surface 323 of the outer frame element 324 together with the bottom surface 313 of the lid shell element 304 defines an interior lid compartment 348. The interior lid compartment 348 is configured such that minimal or no liquid (or other product) enters the interior lid compartment 348. To permit a user to drink liquid from the retainer, the upper outer frame element 324A may include a product tube 350, which is configured to permit the product to flow from the retainer to the drink aperture or other lid opening without coming into contact with the components within the interior lid compartment 348. The upper outer frame element 324A may be generally cup shaped. As illustrated in FIG. 5C, there may be a sealing grommet, sealing gasket, or other tube sealing element 349A positioned around or inside the upper edge of the product tube 350 to minimize or prevent liquid or other product from entering the interior lid compartment 348. The upper outer frame element 324A also may include an actuator element tube 352 configured to permit an actuator element 330 to pass therethrough. A second sealing grommet, sealing gasket, or other tube sealing element 349B may be positioned around or inside the actuator element 330 or the actuator element tube 352 to minimize or prevent liquid or other product from entering the interior lid compartment 348.

In the illustrated embodiment, the interior lid compartment 348 is generally formed by two pieces secured together, but in other embodiments, an interior lid compartment may be formed by a single piece construction (which may possibly include a closeable opening to permit items to be inserted into the interior lid compartment, but the compartment still sealed or generally water-tight); a three-piece construction or alternative construction. Alternatively, a retainer may include an interior retainer compartment (not shown) configured to store internal computer elements, a sensor, or other components and possibly may be configured to be water-tight.

Also shown in FIG. 5C, a third sealing grommet, sealing gasket, or other sealing frame element 351 may be positioned around the bottom frame edge 355 of the upper outer frame element 324A. The frame sealing element 351 is configured to minimize liquid in the thread space between the complementary threads 210, 310 when the complementary retainer threads 210 are connected to the complementary lid threads 310. Accordingly, when a user tips the container system to drink from it, no or minimal liquid leaks out between the retainer 200 and the lid 300.

Figure 7:
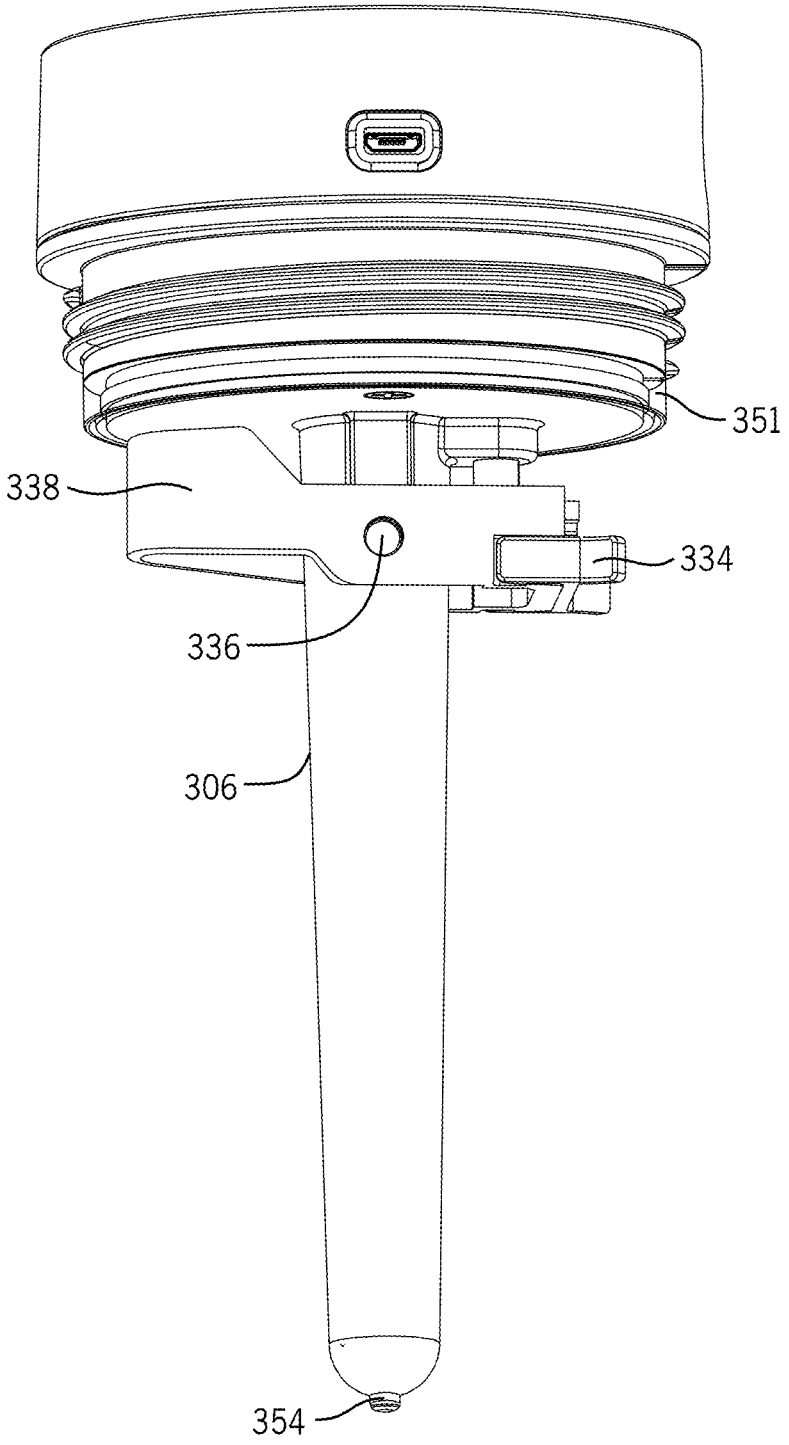
FIG. 7 illustrates a side perspective view of an embodiment of a lid, outer frame element, and lever arm assembly of a container management system.

As shown in FIG. 5B and FIG. 7, the lower outer frame element 324B includes a first fulcrum ridge 336 on a first side and is a second fulcrum ridge on the second side (not shown). The lever arm assembly 332 can be mounted on the respective ridges. Also shown in FIG. 5B and FIG. 7 is a temperature sensor 354 configured to detect the temperature of a product (e.g., a beverage) contained in the retainer while the lid 300 is connected to the retainer 200. The lower outer frame element 324B may be generally cylindrical, generally parabolic-shaped, generally cubical, or generally triangular, to name a few. The lower outer frame element 324B generally extends from the center of the upper outer frame element 322B in the illustrated embodiment, but the lower outer frame element 324B also may extend from the edge, the side, or just a little off-center as well.

The system and methods of the present invention may include one or more additional sensors, each configured to detect a characteristic or event related to the retainer, lid, or contents of the retainer. For example, an orientation sensor, such as an accelerometer, may be incorporated in or by the flexible printed circuit board or the integrated circuit board 342.

The container management system 50 also may include a location sensor configured to detect the geographic location of the container system. Examples of a location sensor include a global positioning system (GPS), other satellite navigation system, other triangulation systems, compass, or magnetic field sensor. In certain embodiments such location sensor may be a system application run by the computer system 500 rather than a separable component. A location sensor may permit the system 50 to detect (and alert the user) if and when the container system 100 is being carried away or left behind relative to a computer system 500 (e.g., a smartphone). A location sensor also may permit a user to identify a location of their container system 100 possibly via a map element in the user interface.

Figure 9:
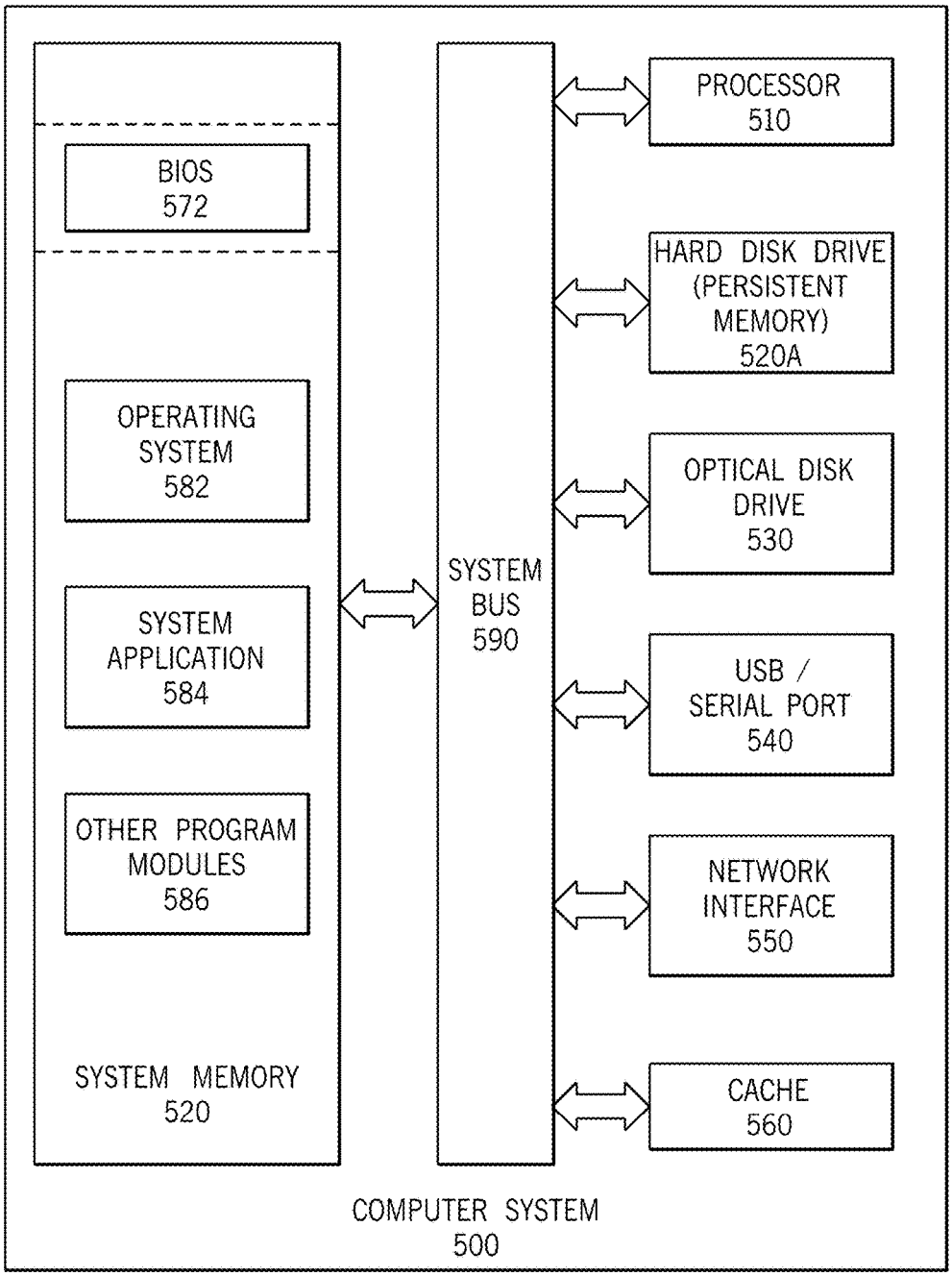
FIG. 9 illustrates an embodiment of a computer system.

Certain embodiments of the system and methods of the present invention include one or more computer elements 502 that may or may not form a full computer system 500. An example of a computer system 500 according to the present invention is illustrated in FIG. 9. The computer system 500 may be a part of the described container management system 50 or may be used to implement related methods. The example hardware and operating environment of FIG. 9 for implementing the described technology includes a computing device, such as a computing device in the form of a processing device, such as a computer, server, or other type of processing device. The computer system 500 illustrated in FIG. 9 includes a processor 510, a cache 560, a system memory 520, and a system bus 590 that operatively couples various system components including the cache 560 and the system memory 520 to the processor 510. There may be only one or there may be more than one processor 510, such that the processor of the computer system 500 comprises a single central processing unit (CPU), a microprocessor, or a plurality of processing units, commonly referred to as a parallel processing environment. The computer system 500 may be a conventional computer, a distributed computer, or any other type of computer; the disclosure included herein is not so limited.

The system bus 590 may be any of several types of bus structures including a memory bus or memory controller, a peripheral bus, a switched fabric, point-to-point connections, and a local bus using any of a variety of bus architectures. The system memory 520 may also be referred to as simply the memory, and includes read only memory (ROM) and random access memory (RAM). A basic input/output system (BIOS) 572, which may contain basic routines that help to transfer information between elements within the computer system 500 such as during start-up may be stored in ROM. The computer system 500 may include a hard disk drive 520A for reading from and writing to a persistent memory such as a hard disk (not shown) and an optical disk drive 530 for reading from or writing to a removable optical disk such as a CD ROM, DVD, or other optical medium.

The hard disk drive 520A and optical disk drive 530 are connected to the system bus 590. The drives and their associated computer-readable medium provide nonvolatile storage of computer-readable instructions, data structures, program engines, and other data for the computer system 500. It should be appreciated by those skilled in the art that any type of transitory and non-transitory computer-readable medium, which can store data that is accessible by a computer, such as magnetic cassettes, flash memory cards, digital video disks, random access memories (RAMs), read only memories (ROMs), and the like, may be used in the example operating environment. In various embodiments, the system memory 520 or hard drive disk 520A store threshold data for various parameters, states, or conditions of the container system 100. By way of example, the threshold data may relate to the pressure, temperature, angle of rotation, and position, among others, of the container system 100 and any contents therein. The threshold data may be retrieved and/or modified by one or more processor(s) 510 of the computer system 500.

The computer system 500 also may include a network interface element 550 such that it can send and receive information via Wi-Fi, Bluetooth, Infrared, ZigBee, Near Field Communication, ANT+, Wireless USB, Z-wave, IEEE Standard 802.15.4, IEEE Standard 802.22, RFID), local area networks, wide area networks, intranets, or other short-range wireless communication technology or long-range wireless communication technology. More specifically, a network interface 550 may provide a two-way data communication coupling via a network link. For example, a network interface 550 may be an integrated services digital network (ISDN) card or a modem, a local area network (LAN) card, or a cable modem or wireless interface. In any such implementation, the network interface 550 sends and receives electrical, electromagnetic, or optical signals which carry digital data streams representing various types of information.

A number of program engines may be stored on the hard disk, optical disk, or elsewhere, including an operating system 582, a system application 584, and one or more other application program modules 586. A user may enter commands and information into the computer system 500 through input devices such as a keyboard and pointing device (e.g., mouse, mini-mouse, mole, trackball, touchpad, trackpoint, touchscreen, stylus, dance pad, remote controller, etc.), any of which may be connected to the USB or Serial Port 540 or may be communicate wirelessly. These and other input devices are often connected to the processor 510 through the USB or serial port interface 540 that is coupled to the system bus 590, but may be connected by other interfaces, such as a parallel port. A monitor, touchscreen, LED device, or other type of display element may also be connected to the system bus 590 via an interface (not shown). In addition to the monitor, computers may include other peripheral output devices (not shown), such as speakers, printers, facsimile machines, game controller (e.g., joystick, wand, etc.), microphone, web camera, other type of camera, etc.

Figure 10A:
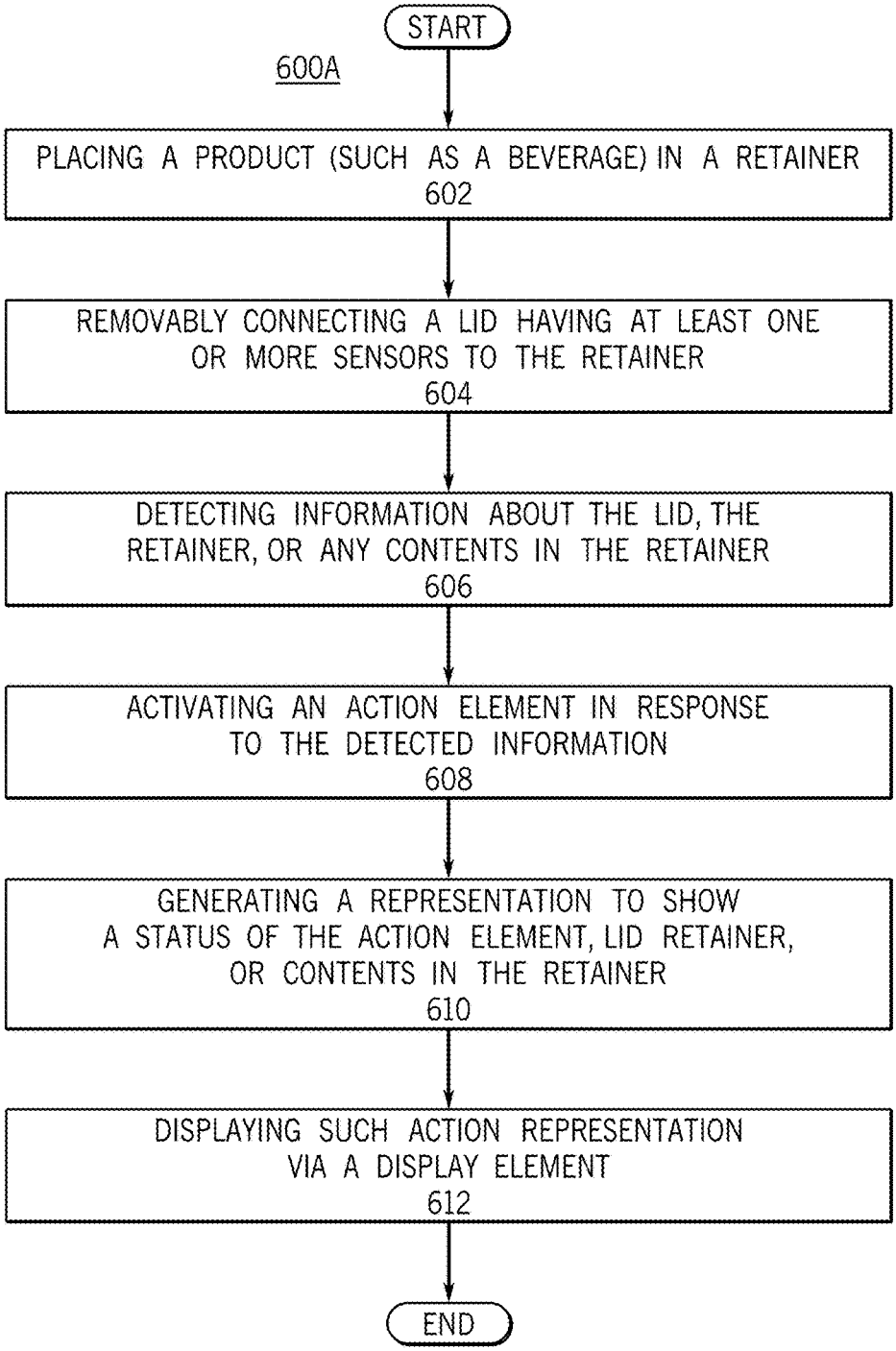
FIG. 10A illustrates a flowchart showing a method embodiment of the present invention.

FIG. 10A illustrates a method embodiment 600A of the present invention. Specifically, a user may place a product (such as a beverage) in a retainer 602. Then, the user may removably connect a lid having at least one or more sensors to the retainer 604. The system may then detect information about the lid, the retainer, or any contents in the retainer 606. Then, the system may activate an action element in response to the detected information 608. An action representation may be generated to show a status of the action element retainer, lid, or lid contents 610. The action representation may be shown or displayed via a display element 612.

Figure 10B:
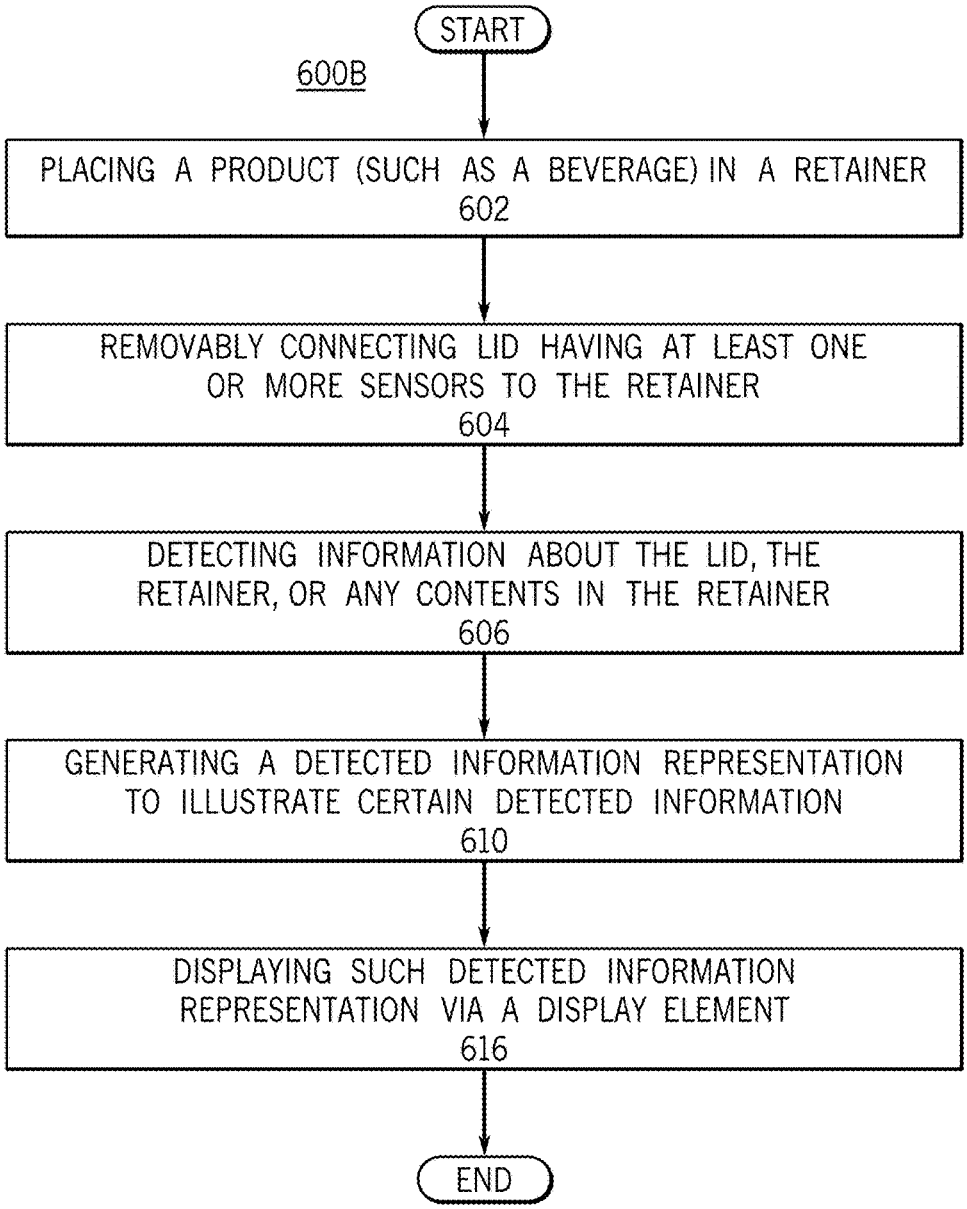
FIG. 10B illustrates a flowchart showing another method embodiment of the present invention.

FIG. 10B illustrates another method embodiment 600B of the present invention. Specifically, a user may place a product (such as a beverage) in a retainer 602. Then, the user may removably connect a lid having at least one or more sensors to the retainer 604. The system may then detect information about the lid, the retainer, or any contents in the retainer 606. Next, the system may produce a detected information representation to illustrate certain of the detected information 614. The detected information representation may be shown or displayed via a display element 616.

Figure 11:
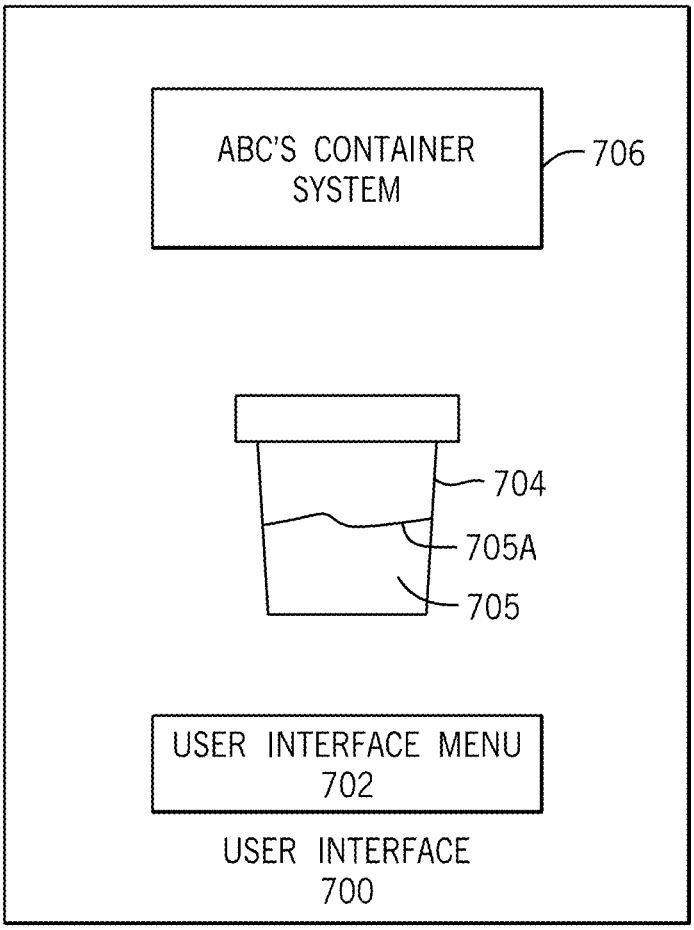
FIG. 11 illustrates an example of a user interface according to the present invention.

The display element may be configured to show or display one or more user interfaces 700, an example of which is illustrated in FIG. 11. The user interfaces 700 may include graphical user interfaces, text-based user interfaces, or combinations thereof. A page of a user interface refers to one or more user interfaces 700 of a series of user interfaces. The pages may be linked or otherwise retrieved from a database and displayed in response to a user action on another user interface in the series. The user interface 700 shown in FIG. 11 includes a user interface menu 702, a representation 704 configured as a drawing of the container system with a fill line 705A that shows the approximate volume of liquid 705 in the retainer that was detected by a sensor, and a system identification symbol 706 configured to identify which container system the representation is referencing.

FIG. 12A-FIG. 12J illustrate additional embodiments of a page 701 of a user interface 700. A user may navigate the user interface by selecting various icon elements 703. Examples of an icon element 703 include a menu icon 703A (selecting causes display of an extended user interface menu 702A), a container system icon 703B (selecting causes display of information or fields about a container system), or a user icon 703C (selecting causes display of information or fields about a user). Other components of the user interface, e.g., representations, may be a type of icon element 703 such that selecting that icon element causes display of different information.

Certain of the illustrations in FIG. 12A-FIG. 12K show a variety of representations 704 including a "time that product has been in the retainer" representation 704A, "how many times the user has sipped from the retainer" representation 704B, "temperature change over period of time" representation 704C, "progress toward goal" representation 704D, a refill information representation 704E, a time frame representation 704F, combined time frame and consumption amount representation 704G, average calculation over a period of time representation 704H, temperature status representation 704I, weather representation 704K, an ounces in most recent sip representation 704L, and an ounces per sip representation 704M. Each page 701 of a user interface 700 may include any combination of representations.

The user interface 700 also may include a system identification symbol 706. The system identification symbol 706 may include a temperature reading element 706A, an "ounces dispensed or consumed" element 706B, or other elements. The system identification symbol 706 also may be configured as a volume representation 704J, such that the fill line 705A represents the relative amount of liquid in the retainer.

Figure 12A:
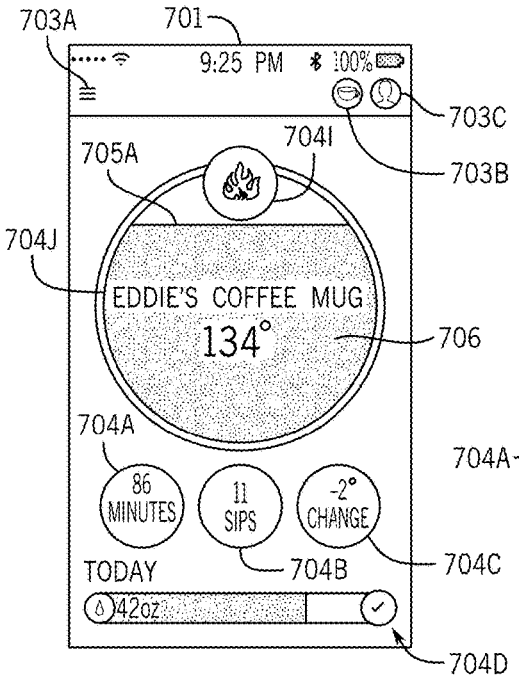
FIG. 12A-FIG. 12M illustrate various examples of a user interface page according to the present invention.
Figure 12B:
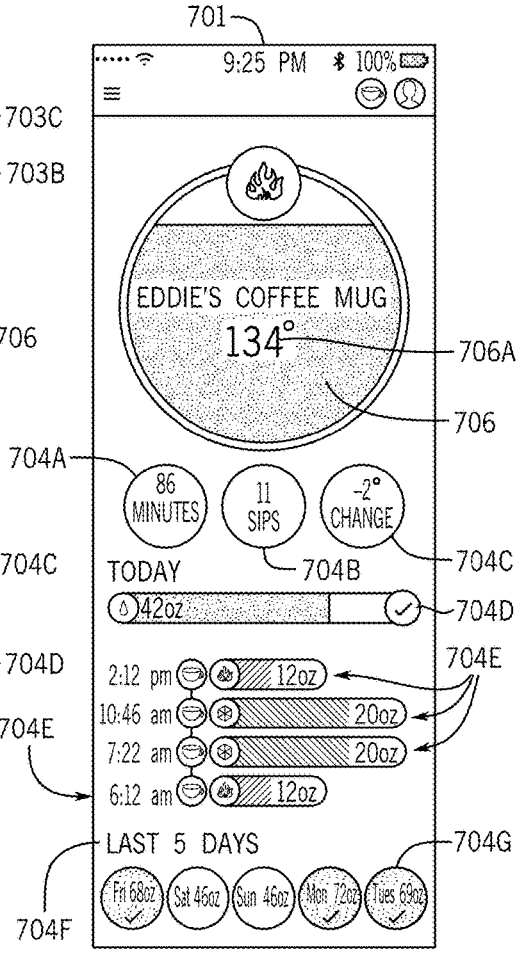
Figure 12C:
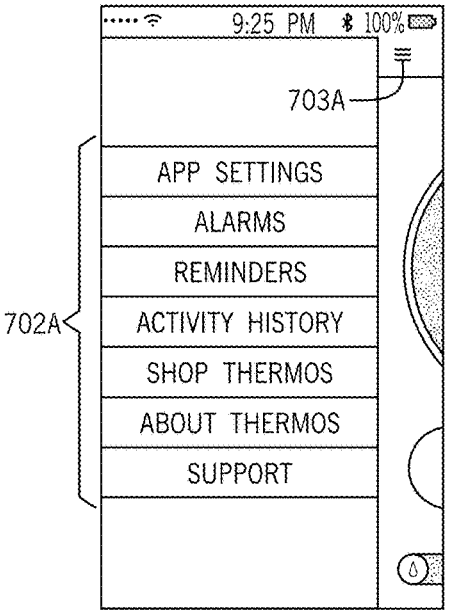
Figure 12E:
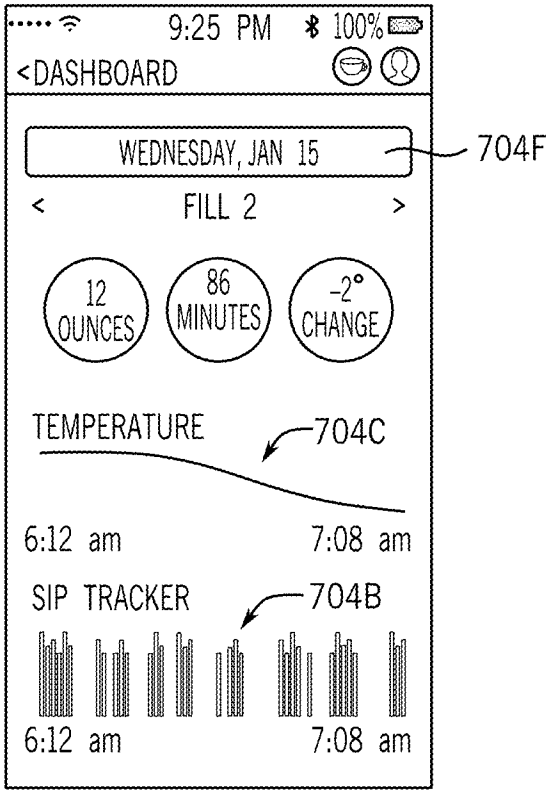
Figure 12D:
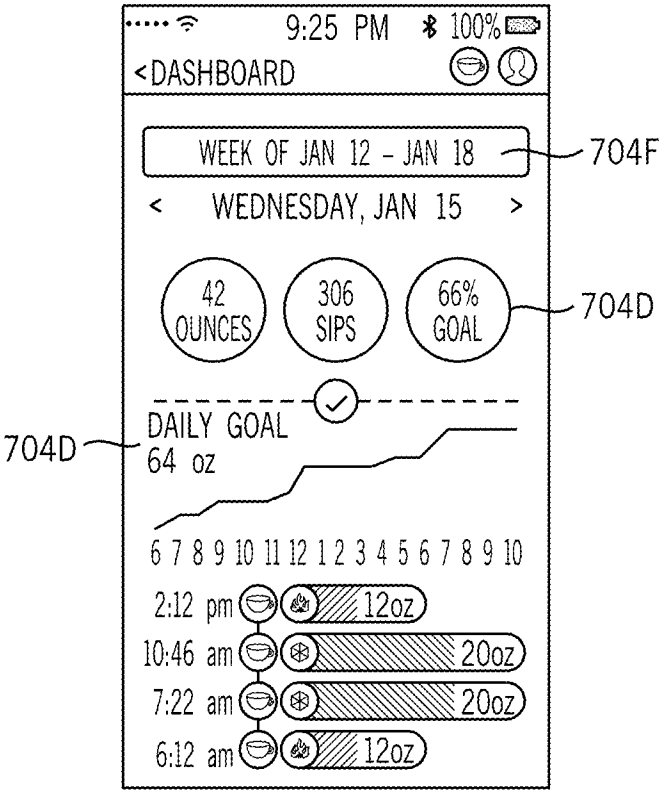
Figure 12F:
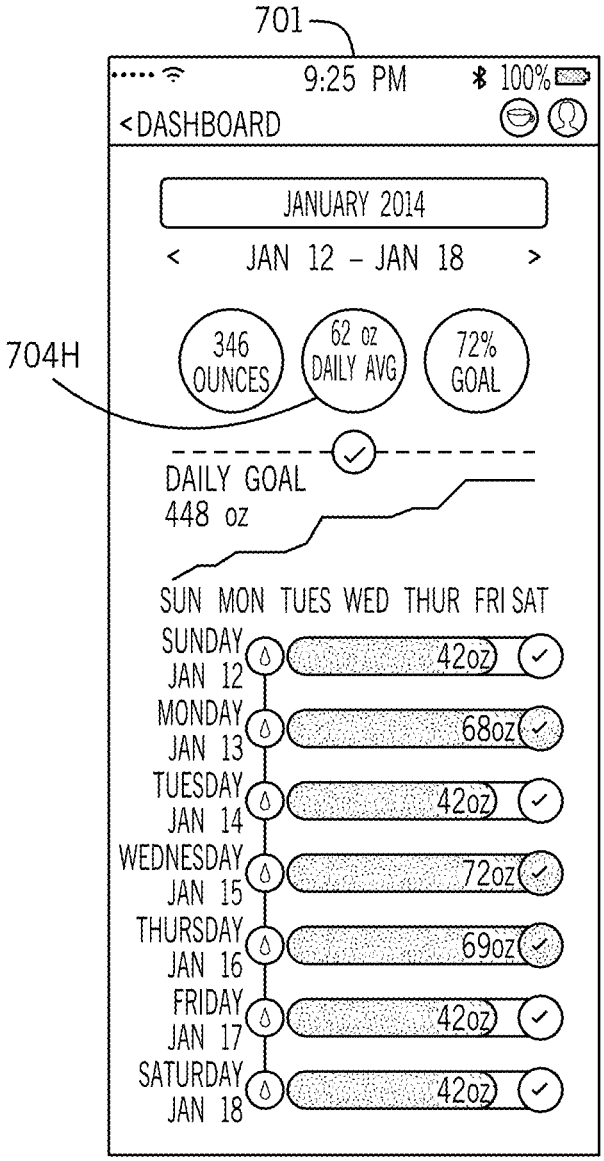

FIG. 12C illustrates an extended user interface menu 702A.

Figure 12G:
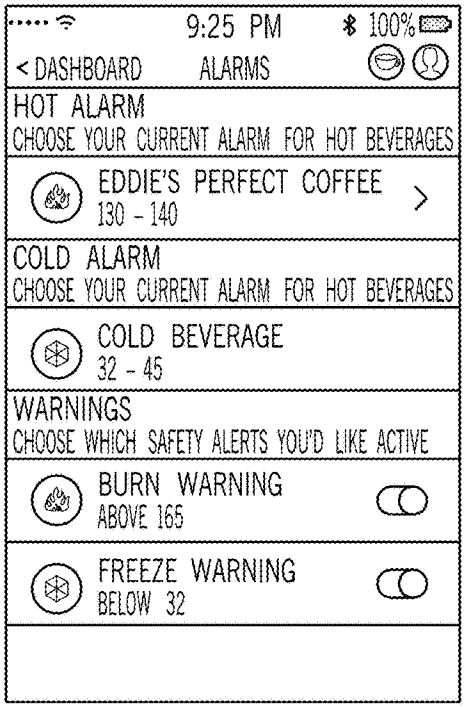
Figure 12H:
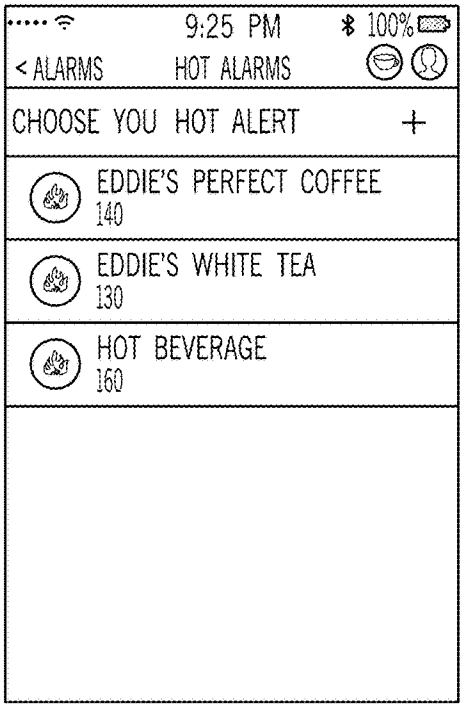
Figure 12I:
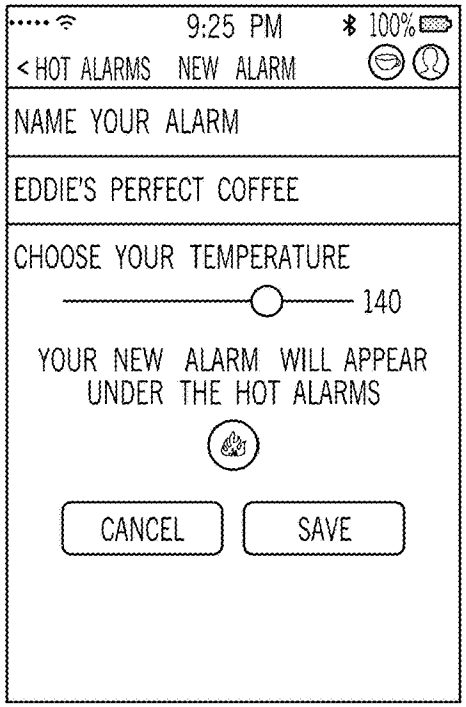
Figure 12K:
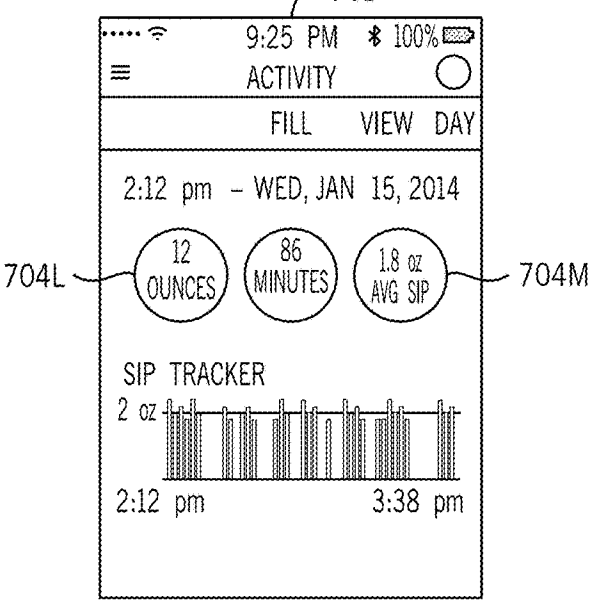
Figure 12J:
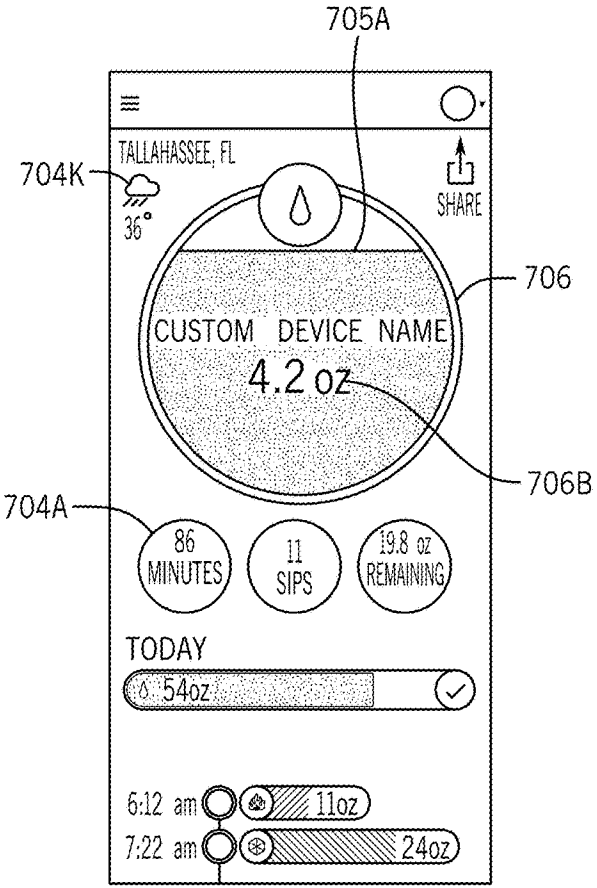

FIG. 12G-FIG. 12I illustrate various pages 701 configured to permit a user to set up alarms or notifications, for example, when a beverage has reached the user's preferred temperature for consumption or a temperature at which consumption is considered safe (e.g., not likely to cause burn).

Figure 12M:
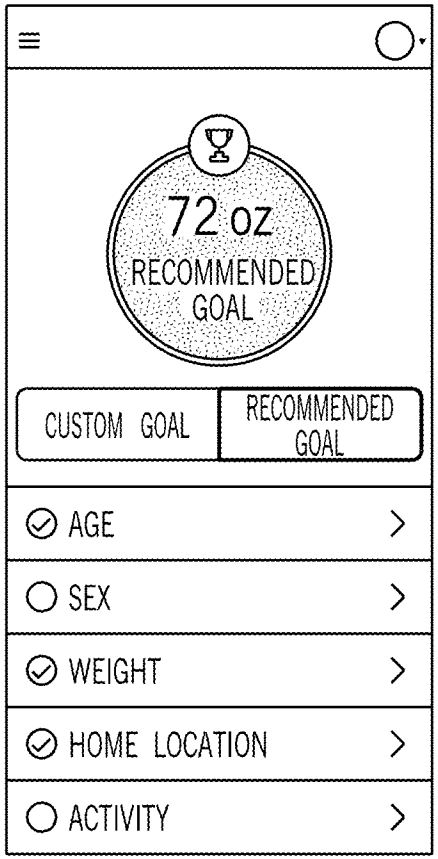
Figure 12L:
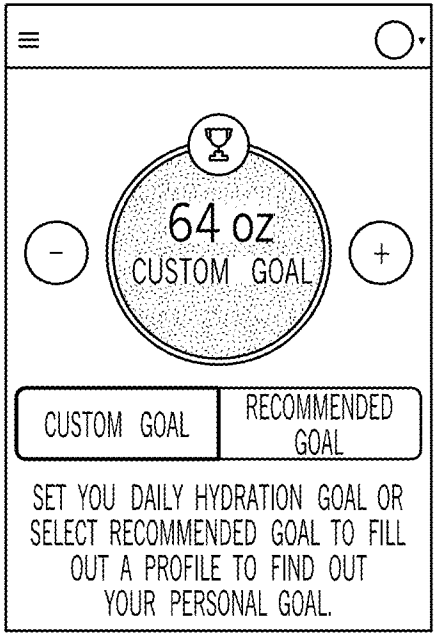

FIG. 12L and FIG. 12M illustrate various pages 701 configured to permit entry of goals about hydration (e.g., drink certain number of ounces of water per day) or caffeine reduction (e.g., limit amount of coffee/tea consumed per day). A user interface page 701 may also be configured to permit entry of goal-determining information (e.g., age, weight, sex, weight loss plans, diet, lifestyle activity level, exercise activity level, home location, altitude, weather, current hydration level), which may permit the system to estimate an appropriate goal (e.g., hydration goal) for the user.

Figure 13A:
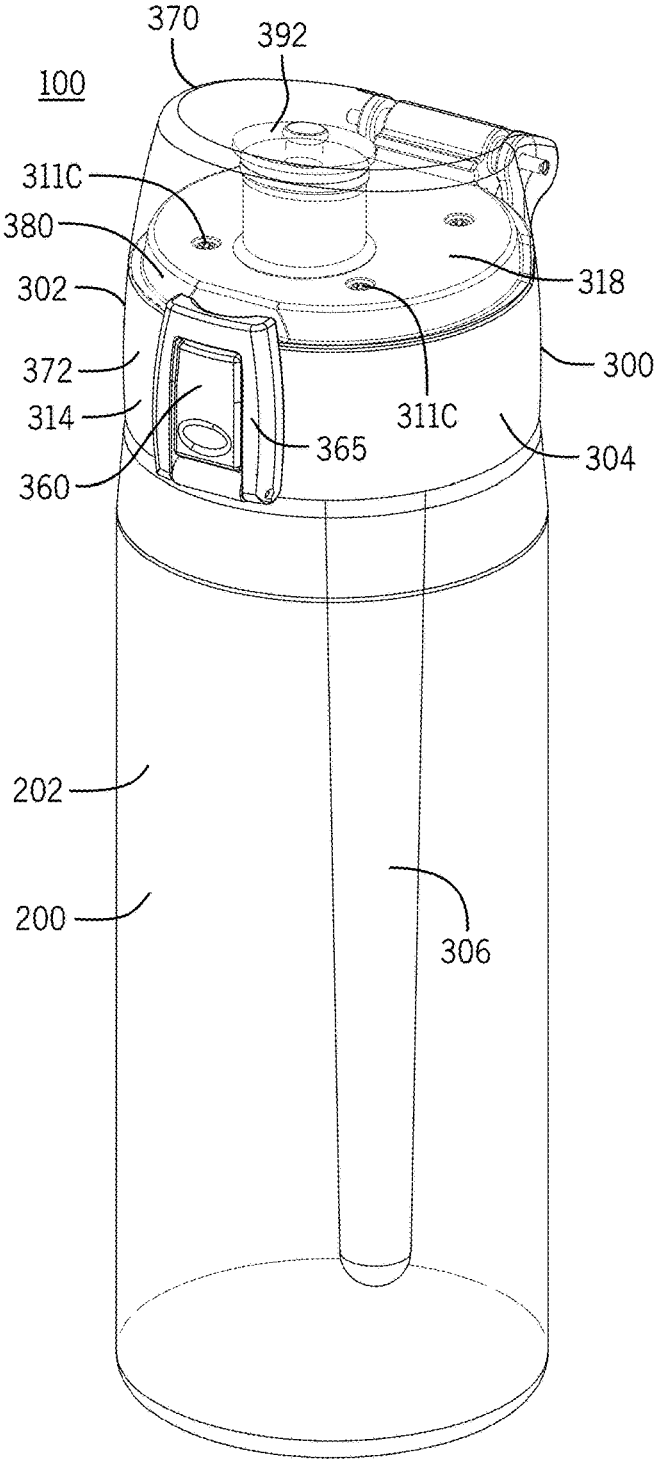
FIG. 13A illustrates another embodiment of a container management system.
Figure 13B:
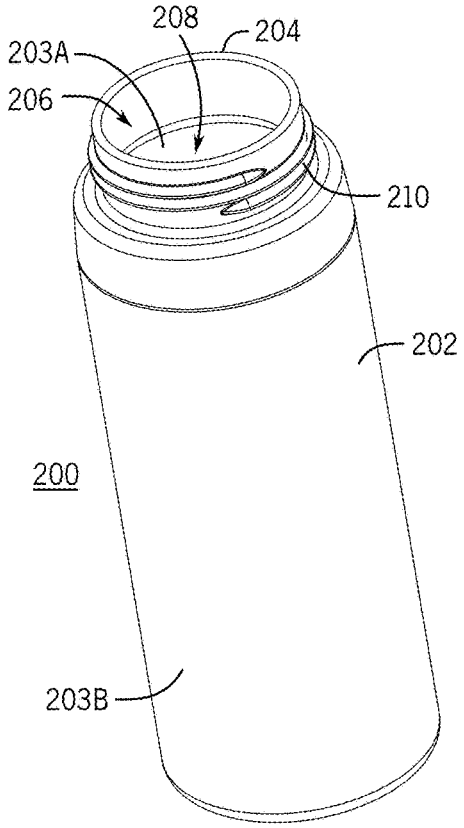
FIG. 13B illustrates another embodiment of a retainer.

FIG. 13A-FIG. 13I illustrate another embodiment of a container system 100 including a retainer 200 and a lid 300. As shown in FIG. 13B, the retainer 200 includes a retainer body 202 configured to receive a product. The illustrated retainer body 202 includes an inner body surface 203A and an outer body surface 203B. The retainer body 202 may terminate at a retainer edge 204, which generally defines a retainer opening 206. A retainer opening 206 may be sized and shaped to permit inserting or pouring a product into the retainer space 208. The illustrated retainer 200 is configured to removably connect to a lid 300 via a set of complementary retainer threads 210 corresponding to a set of complementary lid threads 310, but embodiments of the retainer 200 may have any complementary elements configured to facilitate a removable connection between the retainer 200 and the lid 300.

As illustrated in FIG. 13A, the lid 300 includes a lid body 302 having a lid shell element 304 and a lid support element 306. (Other views of the lid support element 306 are shown in FIG. 13E-FIG. 13I, and is discussed in more detail below.)

Figure 13C:
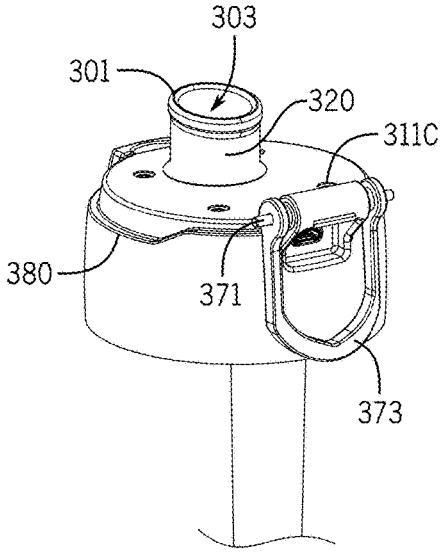
FIG. 13C illustrates a partial perspective view of a lid.
Figure 13D:
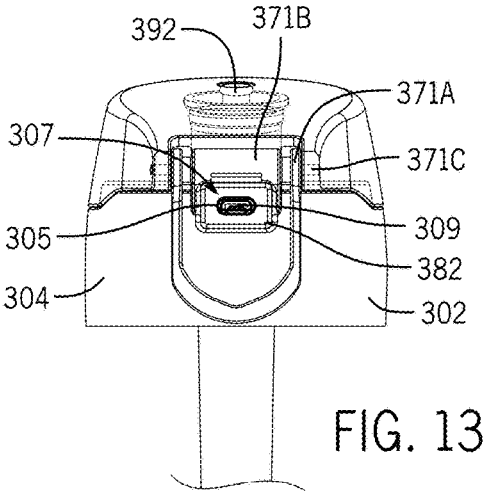
FIG. 13D illustrates a partial back view of a lid.
Figure 13E:
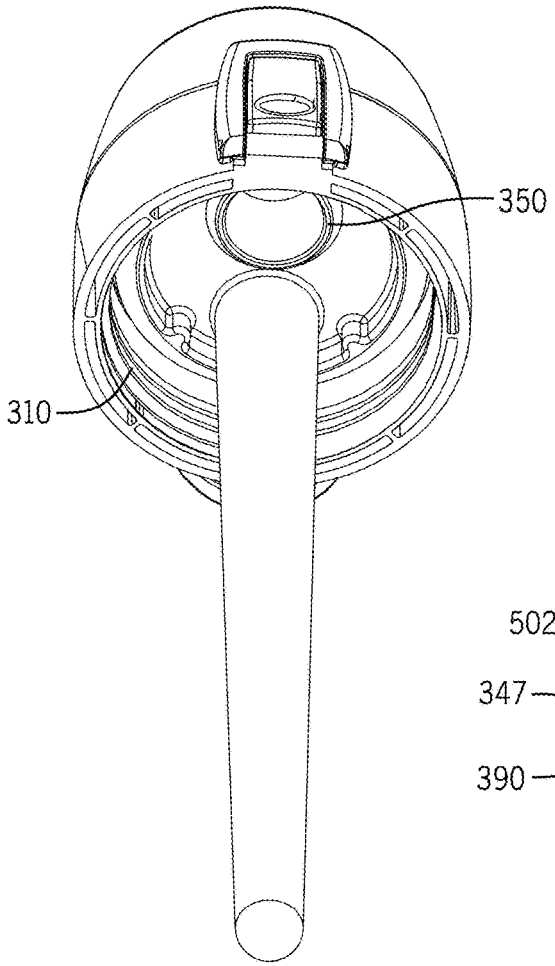
FIG. 13E illustrates a bottom perspective view of a lid.

FIG. 13C illustrates an embodiment of a lid shell element 304 having a first lid edge 301 defining a first lid opening 303 configured as a drink aperture. The drink aperture in this embodiment is elevated via a drink spout 320. FIG. 13D illustrates lid shell element 304 having a second lid edge 305 defining a second lid opening 307 configured as a computer element aperture, specifically, a USB port aperture sized and shaped to fit a USB port 309. The lid shell 304 also may include another lid edge defining another lid opening configured as a securement element aperture 311C.

A lid shell element 304 may include a lid side wall 314, a lid base cover receiving wall 380, and a lid top wall 318. The lid side wall 314 may include an indented section 382 configured to protect the USB port 309. The lid top wall 318 may have a generally linear shape.

The lid shell element 304 may include a hinged lid base cover 370 and a lid base 372. Such embodiments may include a pivot element 371 configured to pass through a cover pivot element 371A of the hinged base cover 370 and a base pivot element 371B of the lid base 372. A pivot element 371 may be, for example, a pin. The hinge also may include a cover biasing element, such as an o-ring, configured to bias the lid base cover toward an open position if it is not latched to the lid base 372. In addition, the hinge also may be the axis connection for a handle 373.

Figure 14A:
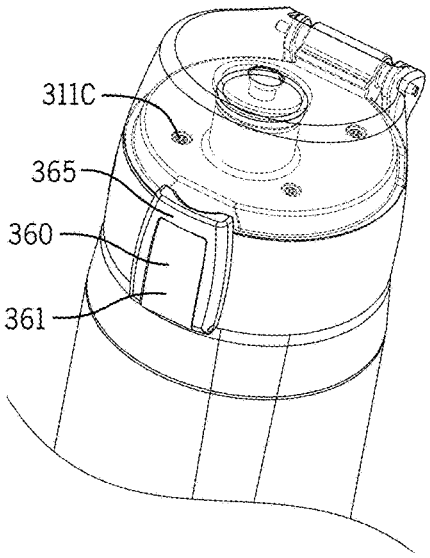
FIG. 14A illustrates a top perspective view of a lid having a lid shell element including a lid base and a lid base cover configured to be released by a mechanical push button assembly.
Figure 14B:
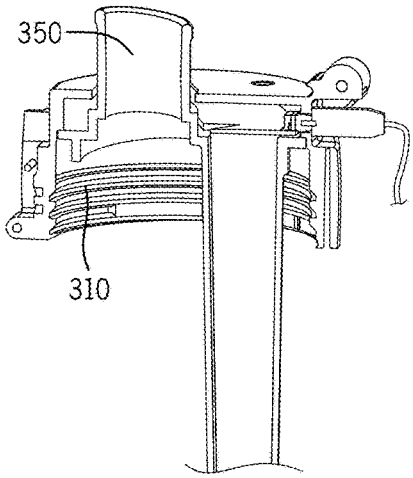
FIG. 14B illustrates a cross section view of a lid shell element and part of a lid support element.
Figure 14C:
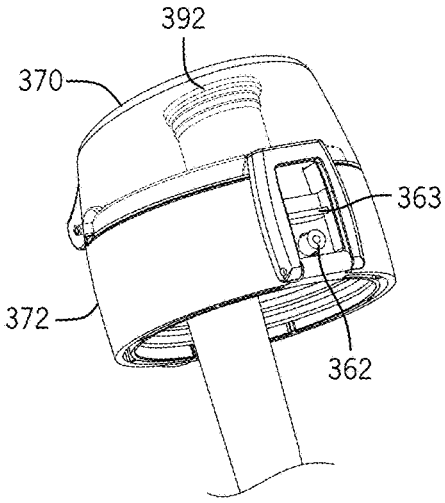
FIG. 14C illustrates a side perspective view of part of a lid support element and a lid shell element having a mechanical button assembly in which the button is removed.
Figure 14D:
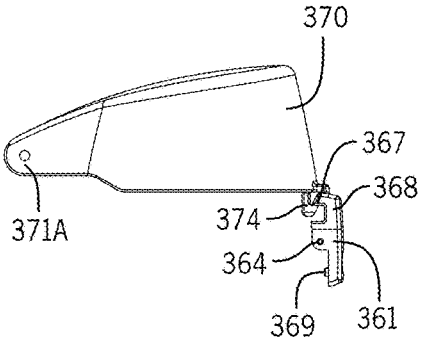
FIG. 14D illustrates a side view of a lid base cover and a button.

The hinged lid base cover 370 may be configured to be released into an open position or latched into a closed position by a mechanical push button assembly 360. As shown in FIG. 14A, FIG. 14C, and FIG. 14D, the mechanical push button assembly 360 may include button 368, a button biasing element 362 configured to bias the button 368 in a certain direction, button fulcrum 363 against which the button 368 may be biased and which connects the button 368 to the lid shell. A button biasing element 362 may include a spring. As illustrated in FIG. 14D, the button 368 may include a front button surface 361, fulcrum receiving opening 364, button latch element 367, and a bias contact element 369. Also shown in FIG. 14D, the lid base cover 370 may include a lid catch element 374 configured to accept the button latch element 367 and thereby secure the lid base cover 370 in a generally closed position. Then, pushing the button typically releases the button latch element 367 from the lid catch element 374 such that the lid base cover 370 transitions to a generally open position. As discussed above, the hinge between the lid base cover 370 and the lid base 372 may have a cover biasing element, such as an o-ring, configured to bias the lid base cover 370 toward an open position if it is not latched to the lid base 372.

The mechanical push button assembly 360 optionally may include a button lock 365 configured to prohibit the button 368 from releasing the lid base cover 370 from the lid base 372 when in the engaged position as shown in FIG. 13A and FIG. 14A. When not engaged, the button lock does not affect the relationship between the lid base cover and the lid base.

Figure 13F:
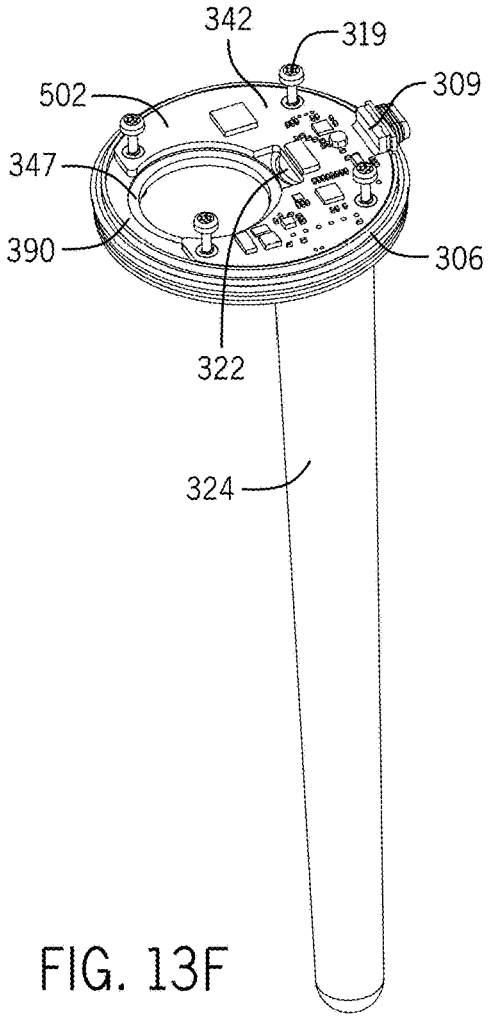
FIG. 13F illustrates a top perspective view of an outer frame element and certain computer elements.

As shown in FIG. 13F, a lid support element 306 is configured to provide structural support for certain other elements of the system, if present, such as sensors, action elements, or computer elements 502. The illustrated lid support element 306 includes an inner frame element 322 (shown from a side perspective view in FIG. 13H and a bottom perspective view in FIG. 13I) and an outer frame element 324 (shown in FIG. 13G in isolation). When the components are positioned for use, the outer frame element 324 generally surrounds at least part of the inner frame element 322.

The inner frame element 322 may support a lower portion of the flexible printed circuit board which may be configured to operate as a volume sensor (not shown). The inner frame element 322 and the volume sensor 346 are sized and shaped such that when the lid 300 is connected to the retainer 200, at least some portion of the volume sensor extends into the retainer space 208. In certain embodiments, the volume sensor 346 may be configured to extend into the bottommost portion of the retainer space 208 or may be configured to extend only into the middle or upper portions of the retainer space 208.

Figure 13G:
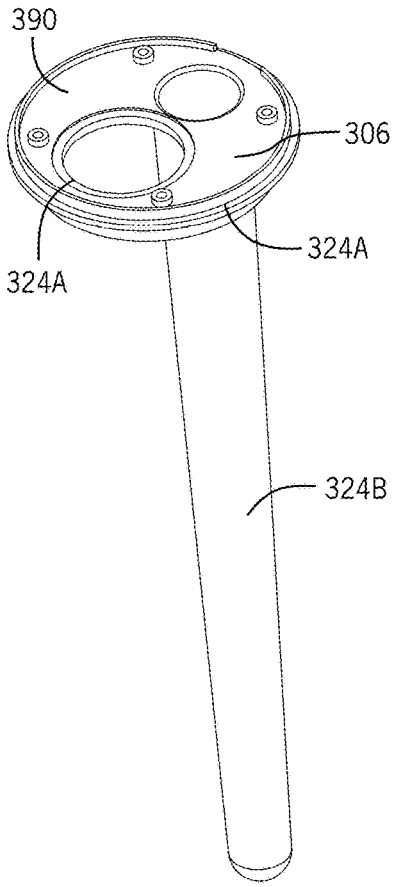
FIG. 13G illustrates a top perspective view of an outer frame element.
Figure 13H:
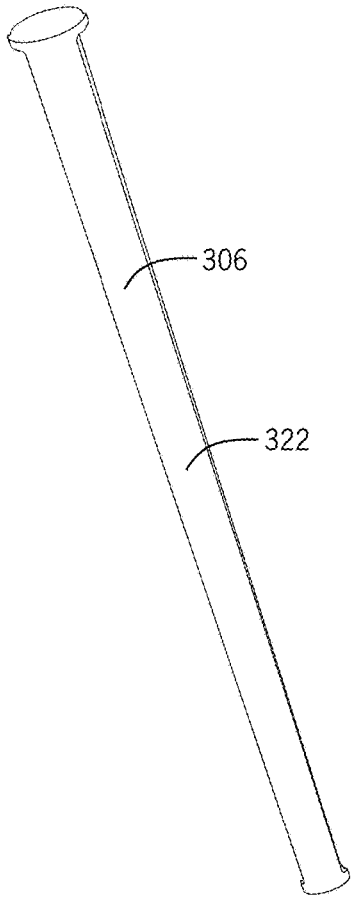
FIG. 13H illustrates a side perspective view of an inner frame element.
Figure 13I:
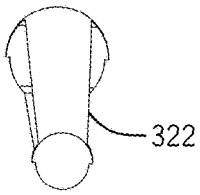
FIG. 13I illustrates a bottom perspective view of an inner frame element.

The upper outer frame element 324A may be generally disc shaped as shown in FIG. 13G. An upper surface 390 of the upper outer frame element 324A together with the bottom surface (not shown for this embodiment) of the lid shell element 304 defines an interior lid compartment. The interior lid compartment is configured such that minimal or no liquid (or other product) enters the interior lid compartment. To permit a user to drink liquid from the retainer, the upper outer frame element 324A includes a product tube opening 347 sized and shaped to receive a product tube 350 (which may include a drink spout 320). The product tube 350 is which is configured to permit the product to flow from the retainer to the drink aperture or other lid opening without coming into contact with the components within the interior lid compartment. There may be one or more sealing grommet, sealing gasket, or other tube sealing element positioned around or near the lower tube edge of the product tube 350 to minimize or prevent liquid or other product from entering the interior lid compartment. A sealing element—such as a sealing frame element—may be positioned around the bottom frame edge of the upper outer frame element 324A. The frame sealing element is configured to minimize liquid in the thread space between the complementary threads 210, 310 when the complementary retainer threads 210 are connected to the complementary lid threads 310. Accordingly, when a user tips the container system to drink from it, no or minimal liquid leaks out between the retainer 200 and the lid 300.

Certain embodiments of the lid base cover 370 may include a sealing element opening configured to receive an aperture sealing element 392 shaped like a mushroom and positioned to completely or partially seal the drink aperture when the lid base cover 370 is latched to the lid base 372. The aperture sealing element 392 may be suspended from a sealing element opening of the lid base cover 370.

Figure 15A:
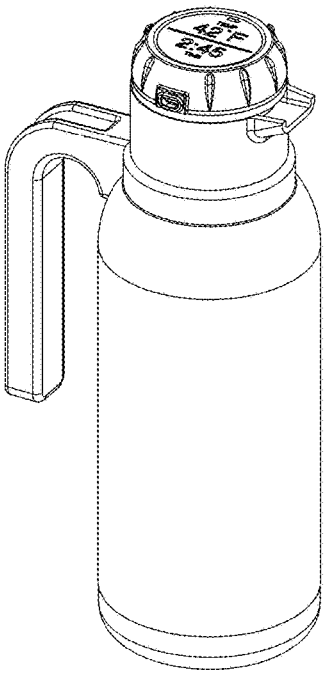
FIG. 15A illustrates a perspective view of an embodiment of a container management system in which the retainer is a creamer carafe.
Figure 15B:
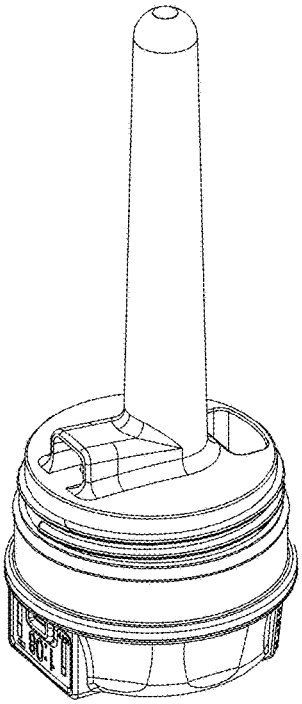
FIG. 15B illustrates an bottom perspective view of an embodiment of a lid for the retainer illustrated in FIG. 15A.
Figure 15C:
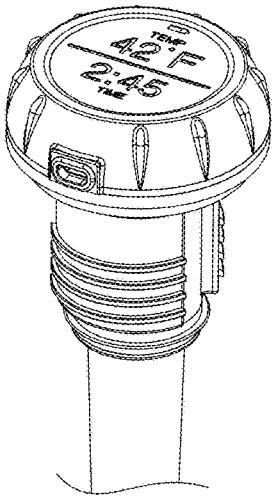
FIG. 15C illustrates an top perspective view of an embodiment of part of a lid for the retainer illustrated in FIG. 15A.

FIG. 15A-FIG. 15C illustrate perspective views of a container system and its components in which the retainer is a creamer carafe. In the illustrated embodiment, the internal user interface is configured to display the temperature of the liquid inside the carafe and the time since the carafe was last filled.

Figure 16A:
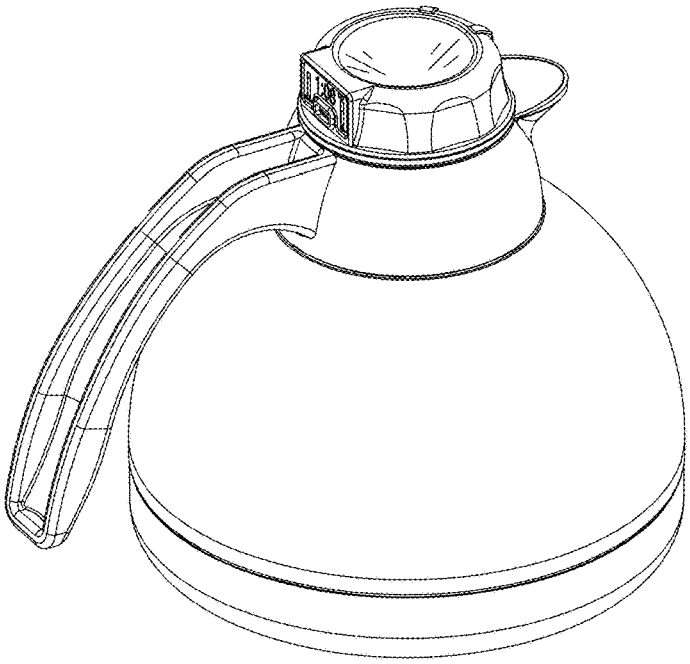
FIG. 16A illustrates a perspective view of an embodiment of a container management system in which the retainer is a coffee carafe.
Figure 16B:
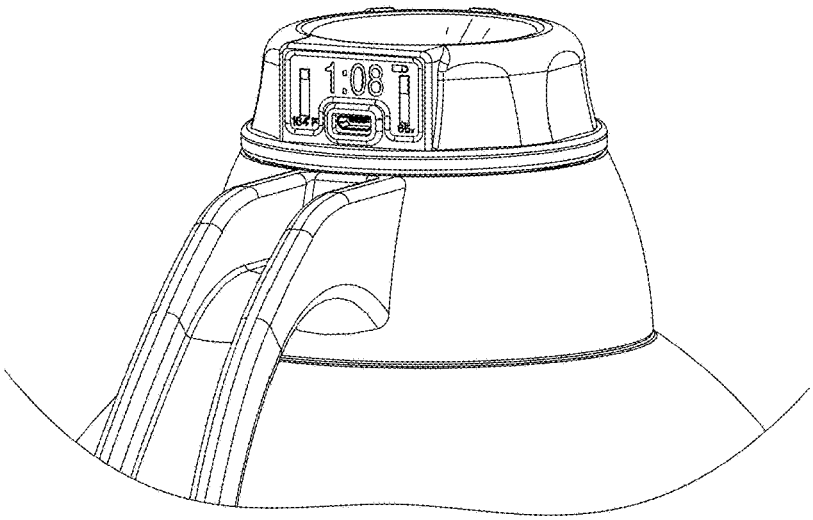
FIG. 16B illustrates a close-up view of a lid and portion of a retainer for the container management system illustrated in FIG. 16A.

FIG. 16A-FIG. 16B illustrate perspective views of an embodiment of a container management system in which the retainer is a coffee carafe.

Figure 17A:
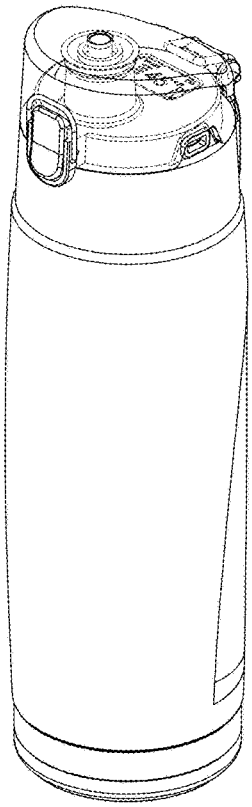
FIG. 17A illustrates a perspective view of an embodiment of a container management system in which the retainer is an insulated hydration bottle and the lid includes a lid shell element having a lid base and a lid base cover.
Figure 17B:
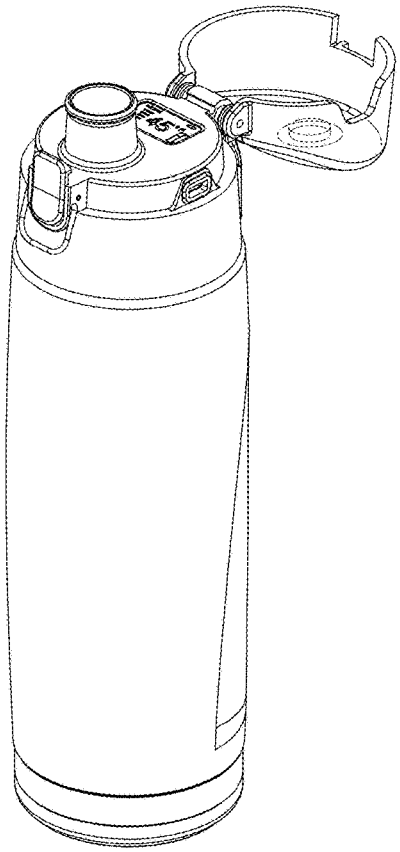
FIG. 17B illustrates the container management system of FIG. 17A in which the lid base cover is released from the lid base such that a user can drink from the lid opening.
Figure 17C:
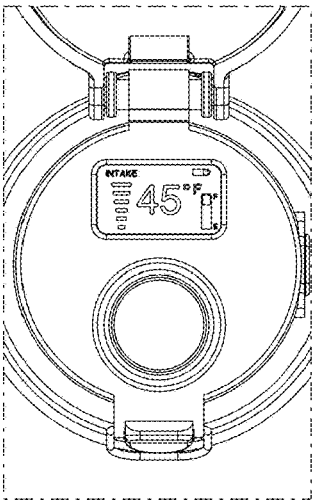
FIG. 17C illustrates the upper base surface on the lid base in the container management system of FIG. 17A.

FIG. 17A-FIG. 17C illustrate perspective views of an embodiment of a container management system or components thereof in which the retainer is an insulated hydration bottle and the lid includes a lid shell element 304 having a lid base 372 and a lid base cover 370. Also, the lid base 370 includes a display element configured to display certain detected information.

Figure 18A:
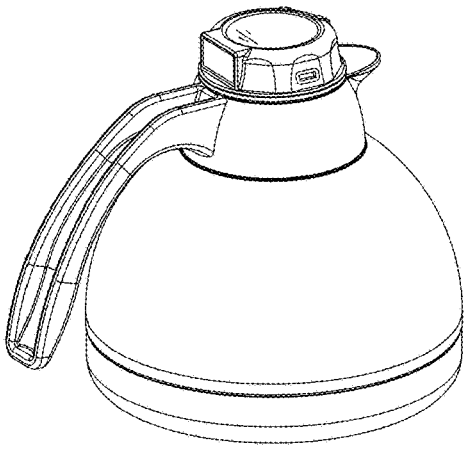
FIG. 18A illustrates a side perspective view of another embodiment of a container system in which the retainer is a carafe.
Figure 18B:
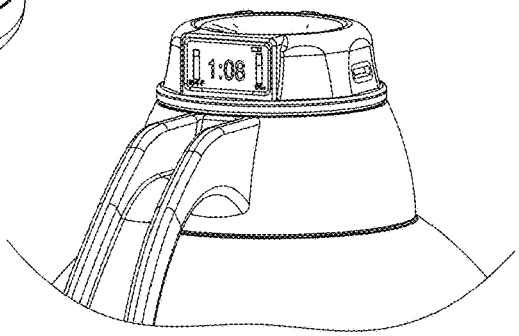
FIG. 18B illustrates a close-up view of part of the embodiment of a container system illustrated in FIG. 18A.
Figure 18C:
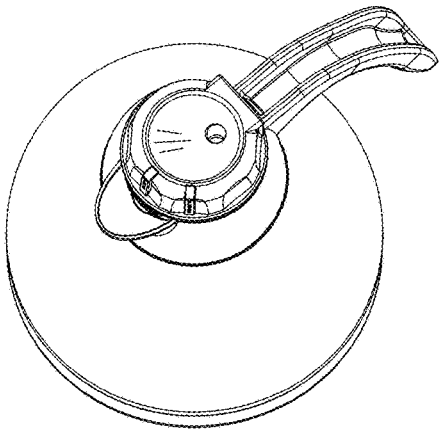
FIG. 18C illustrates a top perspective view of the embodiment of a container system illustrated in FIG. 18A.
Figure 18D:
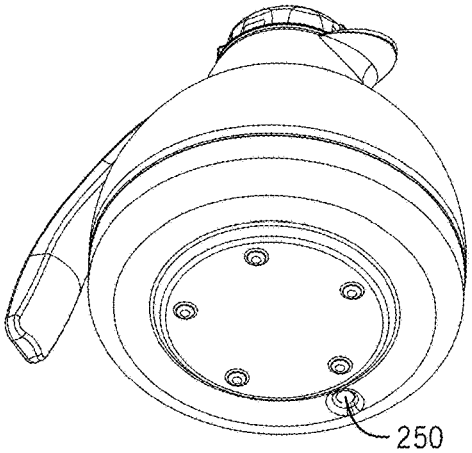
FIG. 18D illustrates a bottom perspective view of the embodiment of a container system illustrated in FIG. 18A.
Figure 19A:
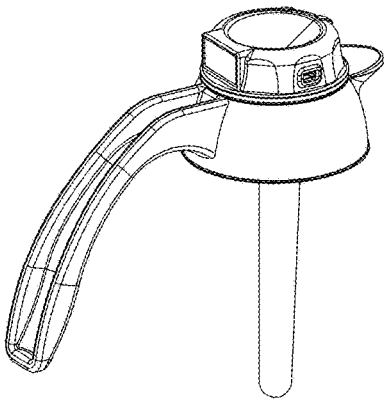
FIG. 19A illustrates a lid configured for use at least with the retainer illustrated in FIG. 18A.
Figure 19B:
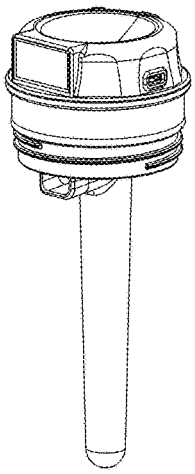
FIG. 19B illustrates the lid of FIG. 19A without the handle and handle collar elements.
Figure 19C:
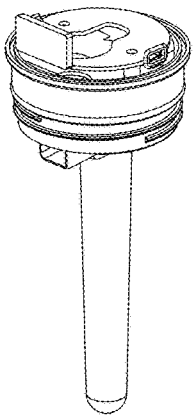
FIG. 19C illustrates the lid of FIG. 19B without the lid shell element.
Figure 19D:
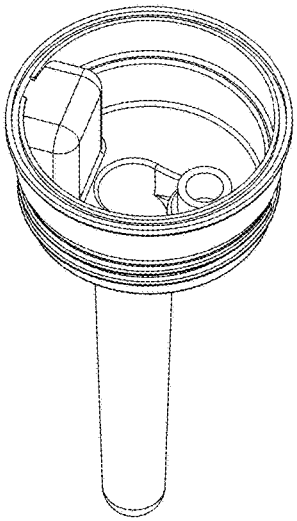
FIG. 19D illustrates a top perspective view of an outer frame element of the lid of FIG. 19A.
Figure 19E:
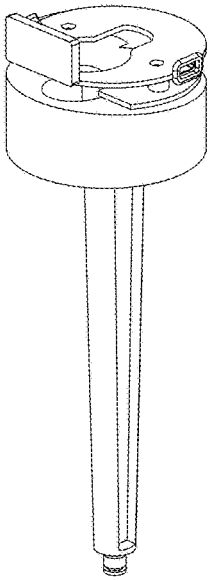
FIG. 19E illustrates a side perspective view of the inner frame element, a display element, USB port, integrated circuit board, a filler element, and a sensor of the embodiment illustrated in FIG. 19A.
Figure 19F:
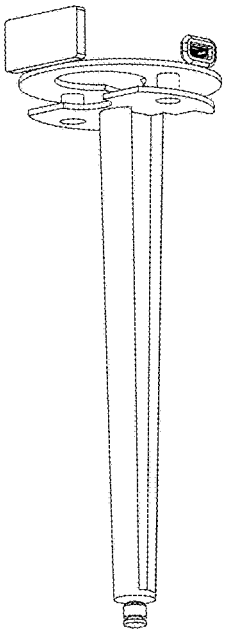
FIG. 19F illustrates a side perspective view of the inner frame element, display element, integrated circuit board, and a sensor.

FIG. 18A-FIG. 18D illustrates various views of another embodiment of a container system in which the retainer is a carafe. As illustrated in FIG. 18D, the base of the carafe includes a vent aperture 250.

FIG. 19A-FIG. 19F illustrates various components of a lid configured for use at least with the retainer illustrated in FIG. 18A. The illustrated embodiment (and other embodiments) may be configured to detect and report only information about temperature and volume or only temperature or only volume of the beverage in the container. The illustrated embodiment does not include an open/close lid opening assembly. A filler element (e.g., foam or plastic block section) may be used to fill certain space between the inner frame element and the outer frame element 383.

Certain embodiments of the present invention may be configured to quickly signal the user about the contents of the retainer. For example, a certain representation may be displayed or a certain component may be different (e.g., different color or shape) to designate whether the retainer is carrying decaffeinated or caffeinated coffee.

While the disclosure is susceptible to various modifications and alternative forms, specific exemplary embodiments of the present invention have been shown by way of example in the drawings and have been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A container management system, comprising:

a lid configured to removably connect to a retainer, the lid including:

a lid shell element having a dispensing aperture, and a lid support element having a lid support opening, each of which are configured to be securable together using securement elements;

an interior lid compartment formed between the lid shell element and the lid support element when the lid shell element and the lid support element are secured together;

internal computer elements, including at least a processor and system memory, positioned in the interior lid compartment;

a first sensor to:

detect information about the lid, the retainer, or contents of the retainer;

and communicate with at least one of the computer elements, wherein the lid support element supports the first sensor; and, the retainer defines a retainer space configured to receive a beverage;

wherein at least some portion of the lid support element is sized and shaped to extend into the retainer space when the lid is removably connected to the retainer, thereby permitting the first sensor to be exposed directly or indirectly to the contents of the retainer while simultaneously being supported by the lid support element.

2. The container management system of claim 1, wherein the first sensor is a volume sensor.

3. The container management system of claim 2, wherein the volume sensor is an indirect capacitance volume sensor configured to measure volume of liquid in the retainer.

4. The container management system of claim 1, further comprising a second sensor in operable communication with at least one of the computer elements and positioned in the interior lid compartment or physically attached to the lid, wherein the second sensor is configured to measure a second characteristic which is different than any characteristic measured by the first sensor.

5. The container management system of claim 4, wherein the second characteristic is a characteristic selected from at least one of temperature of retainer contents, volume of liquid in retainer, orientation of retainer, and status of whether lid opening is open or closed.

6. The container management system of claim 1, wherein the internal computer elements are configured to communicate with application software executable on one or more external computer elements and wherein the application software is configured to display information detected by the first sensor and transmitted by the internal computer elements.

7. The container management system of claim 6, wherein the external computer elements are not configured to be physically integrated with the lid or the retainer.

8. The container management system of claim 6, wherein the transmitted information is provided for display on an external display element.

9. The container management system of claim 8, wherein the transmitted information is a volume representation configured to show volume of liquid in the retainer and the volume representation is updated periodically or generally in real time upon the external computer elements receiving updated detected information.

10. The container management system of claim 8, wherein the external computer elements includes a memory configured to store detected information received from the internal computer elements, and wherein the information is collected over time.

11. The container management system of claim 1, further comprising an open/close lid opening assembly configured to block or unblock the dispensing aperture based on receiving certain detected information.

12. The container management system of claim 11, wherein the open/close lid opening assembly is comprised of:

a motor;

a crank powered by the motor and in mechanical communication with an actuator element;

the actuator element disposed to cause movement of a lever arm assembly; and the lever arm assembly disposed to block or unblock the dispensing aperture or block or unblock an entrance to a product tube leading to the dispensing aperture, upon movement caused by the actuator element.

13. The container management system of claim 12, wherein the crank includes one or more magnets positioned to permit a magnet sensor to detect the orientation of the crank.

14. The container management system of claim 1, wherein the lid shell element includes a lid shell element having a lid base and a lid base cover.

15. The container management system of claim 14, wherein:

the lid base includes a mechanical push button assembly including:

a button having a front button surface and a button latch element, a button biasing element configured to bias the button in a certain direction, a button fulcrum against which the button may be biased and which connects the button to the lid base; and the lid base cover includes a lid catch element configured to accept the button latch element and thereby removably secure the lid base cover in a generally closed position and whereby pushing the button releases the button latch element from the lid catch element such that the lid base cover transitions to a generally open position.

16. The container management system of claim 15, wherein the mechanical push button assembly further includes a button lock configured to prohibit release of the lid base cover from the lid base when the button lock is engaged.

17. A container management system, comprising:

a lid configured to removably connect to a retainer, the lid including:

a lid shell element having a dispensing aperture, and a lid support element, each of which are configured to be securable together using securement elements;

an interior lid compartment formed between the lid shell element and the lid support element when the lid shell element and the lid support element are secured together;

internal computer elements, including at least a processor and system memory, positioned in the interior lid compartment; and a first sensor to:

detect information about the lid, the retainer, or contents of the retainer;

and communicate with at least one of the computer elements, wherein the lid support element supports the first sensor; wherein the lid support element includes an inner frame element and an outer frame element; and, wherein the outer frame element includes a generally disc-shaped upper outer frame element and a lower outer frame element configured to extend almost to a bottom or to a bottom of a retainer space.

18. The container management system of claim 17, wherein the outer frame element includes a generally cup-shaped upper outer frame element and a lower outer frame element configured to extend almost to the bottom or to the bottom of a retainer space.

19. An advanced container management system, comprising:

a lid configured to removably connect to a retainer defining a retainer space, the lid including a dispensing aperture, internal computer elements, and a lid support element, the lid support element includes an inner frame element and an outer frame element; and, wherein the outer frame element includes a generally disc-shaped upper outer frame element and a lower outer frame element, the outer frame element generally surrounding at least part of the inner frame element, the inner frame element supporting a portion of the internal computer elements, the lower outer frame element is sized and shaped to extend into the retainer space when the lid is removably connected to the retainer, thereby permitting a first sensor to be exposed directly or indirectly to the contents of the retainer while simultaneously being supported by the lid support element;

the first sensor to detect information about the lid, the retainer, or contents of the retainer and configured to communicate with an external computer system, wherein the first sensor is positioned in the lid support element.

20. The advanced container management system of claim 19, further comprising the retainer configured to receive and hold a beverage in the retainer space.

21. The advanced container management system of claim 19, wherein the lower outer frame element is generally parabolic-shaped.

22. The advanced container management system of claim 19, wherein the lower outer frame element is configured to extend through at least three-quarters of the retainer space by height.

23. The advanced container management system of claim 19, wherein the lower outer frame element is configured to extend through at least half of the retainer space by height.

24. The advanced container management system of claim 19, further comprising a second sensor configured to communicate with certain computer elements and positioned in or on the lid support element, wherein the second sensor is configured to measure a second characteristic which is different than any characteristic measured by the first sensor.

25. The advanced container management system of claim 19, wherein the internal computer elements are configured to communicate with application software executable on the external computer system, and wherein the internal computer elements transmit the information detected by the first sensor to the application software for display as a representation.

26. The advanced container management system of claim 25, wherein the external computer system is not configured to be physically integrated with the lid or the retainer.

27. The advanced container management system of claim 19, further comprising an open/close lid opening assembly configured to block or unblock the dispensing aperture based on receiving certain detected information.

28. An upgraded container management system, comprising:

a lid having a dispensing aperture, wherein the lid is configured to removably connect to a retainer, the retainer defines a retainer space configured to receive a beverage, the lid having a lid support element having a lid support opening, a sensor to detect information about the lid, the retainer, or contents of the retainer and configured to communicate with one or more internal computer elements;

the one or more internal computer elements, including at least a processor, positioned in a compartment within the lid or a compartment within the retainer and configured to communicate with the sensor and with an application software executed by the processor or an external computer system;

wherein at least some portion of the lid support element is sized and shaped to extend into the retainer space when the lid is removably connected to the retainer, thereby permitting the first sensor to be exposed directly or indirectly to the contents of the retainer while simultaneously being supported by the lid support element.

29. The upgraded container management system of claim 28, where the application software, which includes one or more pages of a user interface configured to show detected information as a representation at the external computer system further comprising at least one external display element.

* * * * *